US007845644B2

(12) United States Patent
Constantine et al.

(10) Patent No.: US 7,845,644 B2
(45) Date of Patent: Dec. 7, 2010

(54) GAME APPARATUS

(75) Inventors: Daniel Richard Constantine, Orland Park, IL (US); David James Constantine, Orland Park, IL (US); Carrie Ann Constantine, Champaign, IL (US)

(73) Assignee: Soarex, Inc., Orland Park, IL (US)

( * ) Notice: Subject to any disclaimer, the term of this patent is extended or adjusted under 35 U.S.C. 154(b) by 0 days.

(21) Appl. No.: 12/627,548

(22) Filed: Nov. 30, 2009

(65) Prior Publication Data

US 2010/0072698 A1 Mar. 25, 2010

Related U.S. Application Data

(63) Continuation-in-part of application No. 12/194,307, filed on Aug. 19, 2008, now Pat. No. 7,766,337.

(51) Int. Cl.
*A63F 7/00* (2006.01)

(52) U.S. Cl. ..... 273/317.6; 273/317; 273/317.1; 273/348

(58) Field of Classification Search ..... 273/317, 273/317.1, 317.6, 348, 353, 398–402
See application file for complete search history.

(56) References Cited

U.S. PATENT DOCUMENTS

| | | | | | |
|---|---|---|---|---|---|
| 817,928 | A * | 4/1906 | Medley | 124/7 |
| 867,935 | A * | 10/1907 | Parker | 273/386 |
| 1,072,954 | A * | 9/1913 | Junn | 273/394 |
| 1,996,986 | A * | 4/1935 | Weinberg | 273/400 |
| 2,520,460 | A * | 8/1950 | Ford | 124/7 |
| 2,799,502 | A * | 7/1957 | Isakson | 273/399 |
| 3,051,488 | A * | 8/1962 | Villa | 273/390 |
| 3,351,344 | A * | 11/1967 | Dupuy | 273/400 |
| 4,323,250 | A * | 4/1982 | Lansberry | 273/400 |
| 4,877,256 | A * | 10/1989 | Falloon | 273/400 |
| 5,320,360 | A * | 6/1994 | St. Pierre | 273/402 |
| 5,333,879 | A * | 8/1994 | Barnes | 273/400 |
| 5,516,114 | A * | 5/1996 | Michlin et al. | 273/400 |
| 5,704,612 | A * | 1/1998 | Kelly et al. | 273/402 |
| 5,732,952 | A * | 3/1998 | Joseph | 273/317.6 |
| 7,325,807 | B1 * | 2/2008 | Eason | 273/342 |
| 7,611,146 | B2 * | 11/2009 | Arden | 273/317 |
| 2003/0224866 | A1 * | 12/2003 | Chen | 473/197 |
| 2003/0228924 | A1 * | 12/2003 | Isom | 473/197 |
| 2007/0284824 | A1 * | 12/2007 | Arden | 273/317 |
| 2008/0211189 | A1 * | 9/2008 | Williams et al. | 273/348 |

* cited by examiner

*Primary Examiner*—Raleigh W. Chiu
(74) *Attorney, Agent, or Firm*—Beem Patent Law Firm

(57) ABSTRACT

A game playing apparatus configured to facilitate playing a game is provided. The apparatus includes a body having a plurality of sides. The body includes a plurality of receptacles, wherein each receptacle has an ingress with an inclined surface extending downward from the ingress to facilitate return of a game playing member, and a plurality of indentations in at least one side. The apparatus further includes a game surface coupled to the body. The game surface includes a return surface beneath the plurality of receptacles to further facilitate return of the game playing member, and a plurality of holders. The plurality of holders and the plurality of receptacles are configured to receive a plurality of cups therein.

14 Claims, 13 Drawing Sheets

GAME APPARATUS

CROSS-REFERENCE TO RELATED APPLICATIONS

This application is a continuation-in-part of U.S. patent application Ser. No. 12/194,307, filed on Aug. 19, 2008.

BACKGROUND OF THE INVENTION

1. Field of the Invention

The present invention is directed to a game apparatus, particularly to an apparatus to facilitate playing a baseball-themed game.

2. Description of the Related Art

Games generally are created when a person comes up with an idea for a game and makes the game board and/or apparatus out of easily accessible resources such as household products. Constantly using household products may be time consuming, inefficient and wasteful.

A known household game includes a plurality of plastic cups and a coin. The player tosses the coin towards the cups and points are scored when the coin lands in one of the cups. This game apparatus is inefficient as the cups are often knocked over while the game is being played and the coin frequently falls between the cups rather than in one of the cups.

What is needed is a game apparatus for a game that is played by tossing a coin towards receptacles that overcomes shortcomings of prior art games and can be used repeatedly.

BRIEF SUMMARY OF THE INVENTION

In one aspect of the invention, a game playing apparatus is provided. The apparatus is configured to facilitate playing a game. The apparatus includes a body including at least one first column including at least one receptacle and a second column coupled to the at least one first column. The second column has an upper surface having a plurality of openings such that a member may be tossed into at least one of the openings. The apparatus also includes a game surface coupled to the body, and a backboard coupled substantially perpendicular to the game surface.

In another aspect of the invention, a game playing apparatus configured to facilitate playing a game is provided. The apparatus includes a body having a plurality of sides. The body includes a plurality of receptacles, wherein each receptacle has an ingress with an inclined surface extending downward from the ingress to facilitate return of a game playing member, and a plurality of indentations in at least one side. The apparatus further includes a game surface coupled to the body. The game surface includes a return surface beneath the plurality of receptacles to further facilitate return of the game playing member, and a plurality of holders. The plurality of holders and the plurality of receptacles are configured to receive a plurality of cups therein.

These and other features and advantages are evident from the following description of the present invention, with reference to the accompanying drawings.

DETAILED DESCRIPTION OF THE ILLUSTRATED EMBODIMENTS

Figure 1:
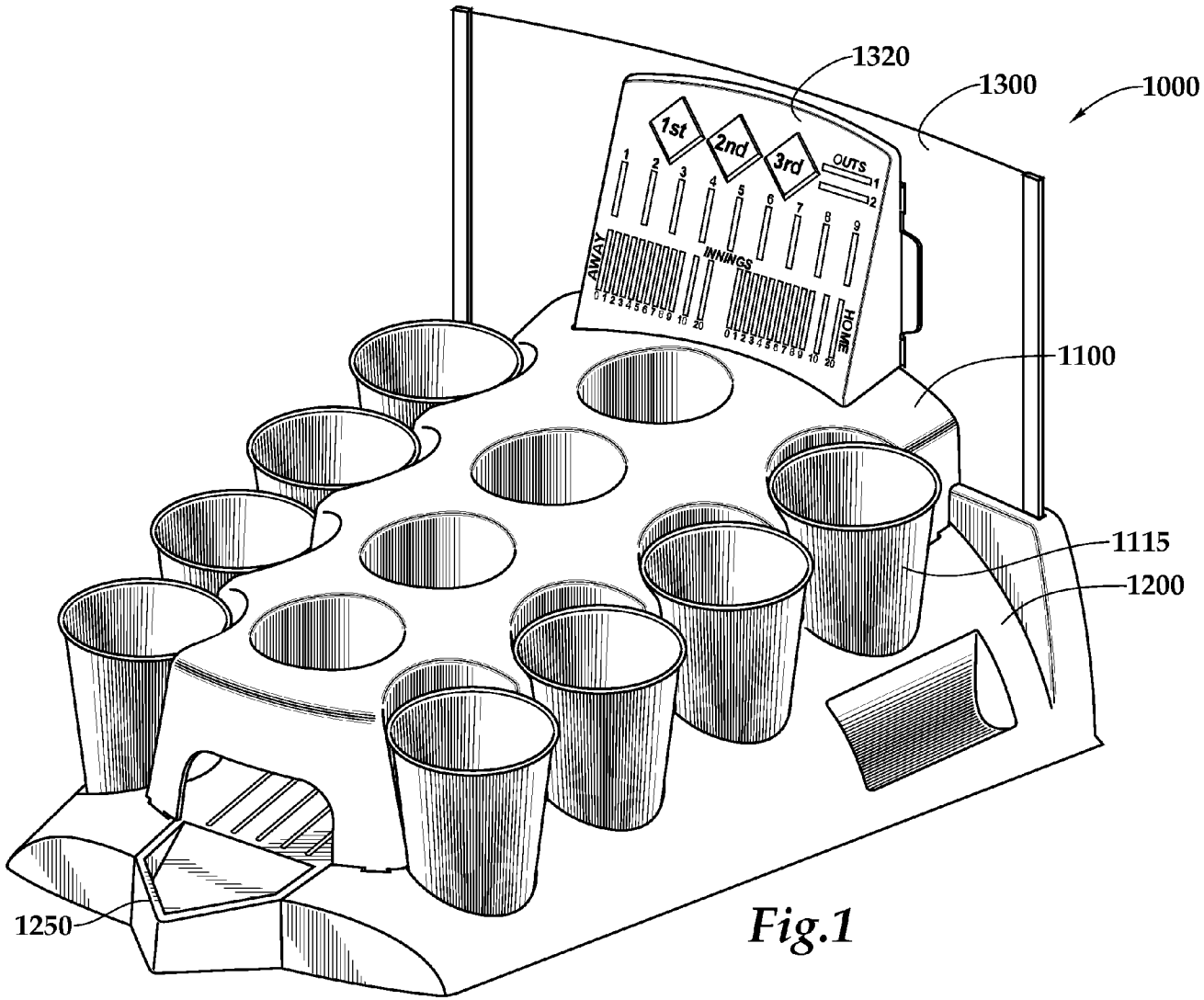
FIG. 1 is a perspective view of an embodiment of a game apparatus.

Referring to FIGS. 1A-9, a game playing apparatus 10 is a baseball-themed apparatus configured to facilitate playing a baseball-themed game. However, game apparatus 10 may be an apparatus to facilitate playing a football-themed game or another sports-themed game. Apparatus 10 may include a game playing body or a body 100, a game surface or a surface 200, and a game playing backboard and/or a backboard 300. When playing the baseball-themed game, a player tosses a game playing member or a member 400 towards body 100 with the goal of landing game playing member 400 within body 100 to score points for his/her team. Member 400 may be bounced on a surface to catapult member 400 towards body 100.

Game Playing Body 100

Game playing body 100 is configured to receive game playing member 400 and is configured to couple to game playing surface 200. In one embodiment, body 100 may be unitarily formed of a plastic material that is injection molded. Preferably, body 100 is fabricated of plastic having a thickness between about 1/16" and about 1/2", and more preferably between about 1/8" and about 1/3", and in one example about 1/4". In another embodiment, body 100 may be formed as portions and coupled together. Moreover, in another embodiment, body 100 may be fabricated from any suitable material. For example, body 100 may be fabricated from, but not limited to being fabricated from, metal, paper, nylon, polycarbonate, polyester, polyethylene, polypropylene, wood, laminate, glass, stainless steel, ceramics, and/or any combination thereof that facilitates the functionality of body 100. Further, body 100 may be of a chosen color to reduce and/or inhibit thermal communication. For example, body 100 may be fabricated specifically from light grey plastic rather than black plastic to reduce the retention of heat within body 100.

Body 100 may include a first column or a first portion 110, a second column or a second portion 120, a third column or a third portion 130, and/or a base portion 140. In one embodiment, second portion 120 is unitarily formed between first portion 110 and third portion 130. In another embodiment, portions 110, 120 and 130 are formed separately and coupled together such that second portion 120 is coupled between first portion 110 and third portion 130. In one embodiment, first portion 110 and second portion 120 may be aligned substantially parallel with an axis 111. Further, in one embodiment, third portion 130 may also be substantially parallel with axis 111. Specifically, in one embodiment, first portion 110 and third portion 130 are minor images of one another along axis 111.

First portion 110 and third portion 130 may include a plurality of cup receptacles or a plurality of receptacles 112 configured to receive a plurality of cups 115 therein. Specifically, in one embodiment, first portion 110 and third portion 130 each has approximately four cup receptacles 112 extending between a front end 113 and an opposing rear end 117. Further, in one embodiment, cup receptacles 112 are colinear. In one embodiment, a thickness 119 is defined between each respective cup receptacle 112.

Each cup receptacle 112 is configured to receive a cup 115. Cups 115 may have varying size and shape, and may be fabricated from various materials. Preferably, cups 115 are similar in size and are plastic to prevent cups 115 from breaking while apparatus 10 is in use. In another embodiment, cups 115 are of varying height.

Each cup receptacle 112 may include a base 114 and a sidewall 116 extending upward therefrom. In one embodiment, each base 114 has a substantially round shape with a diameter 118 and a thickness 121. In another embodiment, base 114 may have any suitable shape. Further, in one embodiment, each base 114 may include an opening (not shown) defined therein to expel or channel moisture that may accumulate on base 114 from each cup 115.

In one embodiment, each sidewall 116 may be substantially cylindrically or arcuately shaped with a diameter 122 that is approximately the same as diameter 118 such that each sidewall 116 is configured to at least partially retain and/or contact a cup 115. Further, in one embodiment, each sidewall 116 has a height 124 extending between a first end 126 and an opposing second end 128 with a substantially constant thickness between ends 126 and 128. In a further embodiment, each sidewall 116 may be tapered between first end 126 and second end 128 such that a diameter (not shown) of end 126 is larger than diameter 118 of end 128. Tapered sidewalls 116 may facilitate increased ability to retain cups 115.

Additionally, in one embodiment, each sidewall 116 may include an opening or cutout portion 134 defined therein. Cutout portion 134 may have any size and be sized to facilitate easy insertion or removal of cups 115 with respective receptacles 112. In one embodiment, cutout portion 134 has a substantially arcuate shape, specifically U-shaped, extending between a first end 136 and a second end 138. In one embodiment, cutout portion 134 may have an angled or tapered surface 141. Cutout portion 134 may further be fabricated with a lip or flange (not shown) extending therefrom to facilitate retaining cup 115 therein. Moreover, cutout portion 134 is defined such that a distance 142 is defined between each base 114 and game playing surface 200. Distance 142 may vary for each cup receptacle 112. For example, distance 142 is less for a cup receptacle 112 proximate front end 113 than distance 142 for a cup receptacle 112 proximate rear end 117. Distance 142 may vary such that a cup 115 within a cup receptacle 112 proximate rear end 117 is higher than a cup 115 within a cup receptacle 112 proximate front end 113.

In one embodiment, second portion 120 is coupled between first portion 110 and third portion 130. Second portion 120 may include a top portion 150 and an opposing bottom portion 160. Specifically, in one embodiment, top portion 150 is coupled to first portion 110 and second portion 130 proximate sidewall first ends 126 of cup receptacles 112, and bottom portion 160 is coupled to first portion 110 and second portion 130 proximate sidewall second ends 128 of cup receptacles 112.

Top portion 150 may include a surface or portion 152 that extends between proximate front end 113 to proximate rear end 117 and along axis 111. In one embodiment, portion 152 is coupled between first and third portions 110 and 130 proximate each first end 126 of sidewalls 116 of cup receptacles 112. Preferably, portion 152 extends between first and third portions 110 and 130 to prevent game playing member 400 from falling into a crevice of apparatus 10 while the game is being played. In one embodiment, surface 152 is substantially planar. In another embodiment, portion 152 may include rivets and/or curves formed within portion 152 to increase the difficulty of the game such that the rivets and/or curves are designed to deflect game playing member 400 from apparatus 10.

A plurality of openings 154 may be formed within 152. Openings 154 are at graduated heights between front end 113 and rear end 117. Particularly, openings 154 ascend between front end 113 and rear end 117. For example, approximately four openings 154 may be formed within portion 152 to correspond to the number of cup receptacles 112 within first and third portions 110 and 130. Further, openings 154 are formed substantially parallel to axis 111.

Moreover, openings 154 may be labeled or include indicia that progressively read single, double, triple, and/or home run. Preferably, opening 154 closest to front end 113 would be labeled single, and opening 154 closest to rear end 117 would be labeled home run. Plurality of openings 154 may have a diameter 156. In one embodiment, diameter 156 is sized to be substantially the same size as diameter 118 of base 114. However, diameter 156 may be any size that facilitates operation of apparatus 10. Moreover, top portion 150 may include an overhang portion 158 proximate front end 113 that extends a distance outward from substantially planar portion 152.

Figure 1A:
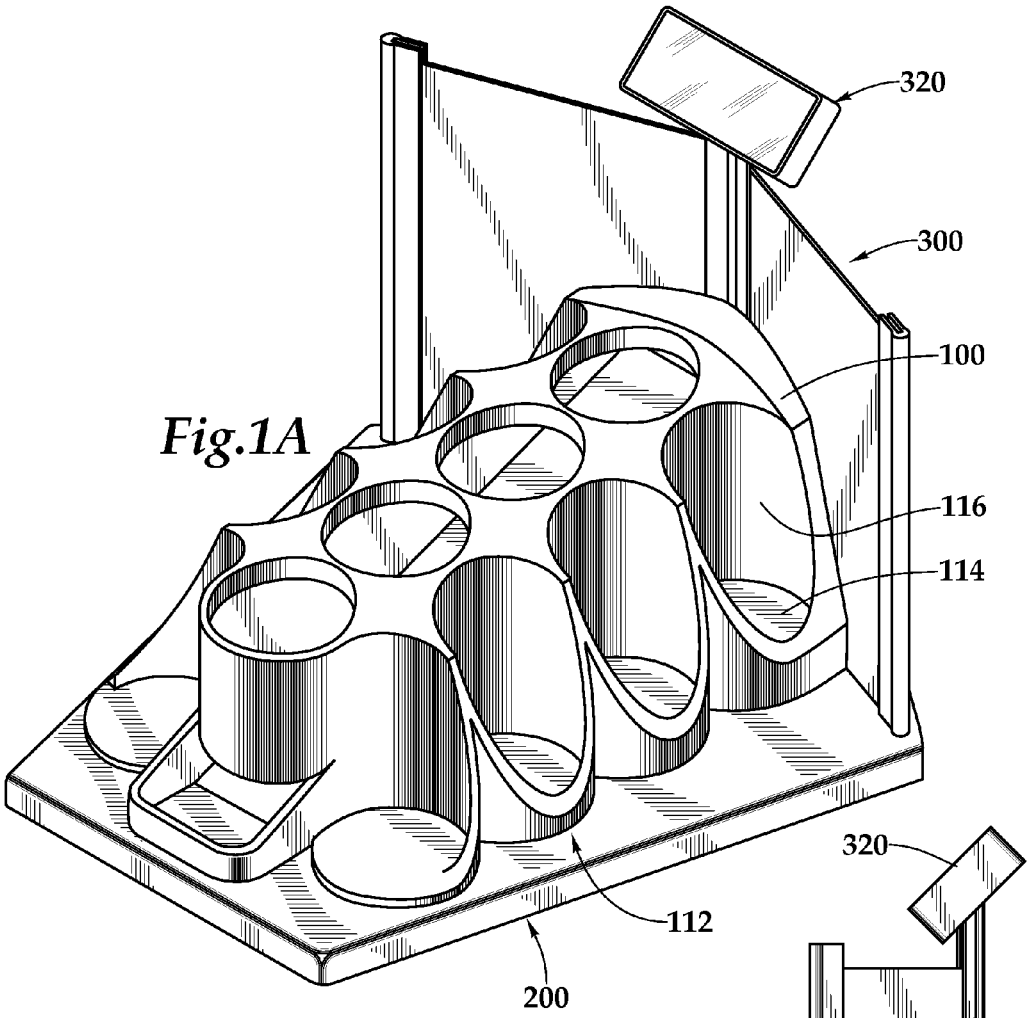
FIG. 1A is a perspective view of another embodiment of a game apparatus.
Figure 4:
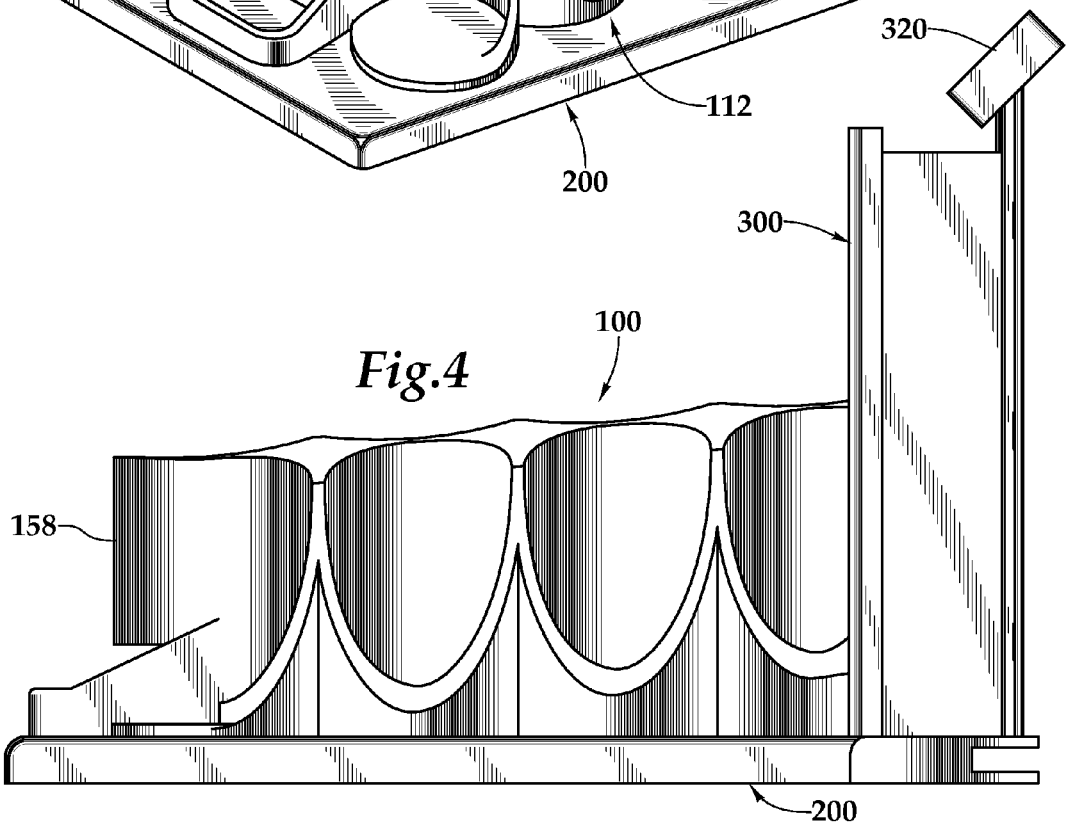
FIG. 4 is a side view of the game apparatus shown in FIG. 1A, the other side being a minor image thereof.
Figure 2:
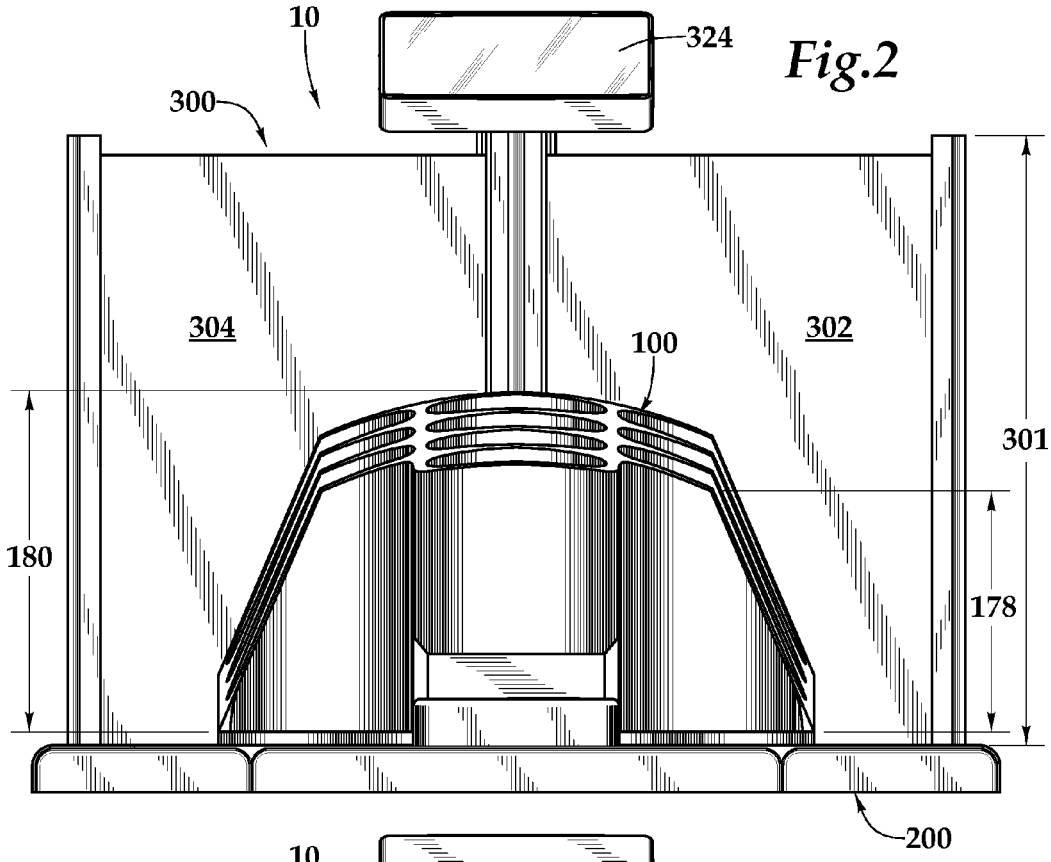
FIG. 2 is a front view of the game apparatus shown in FIG. 1A.
Figure 3:
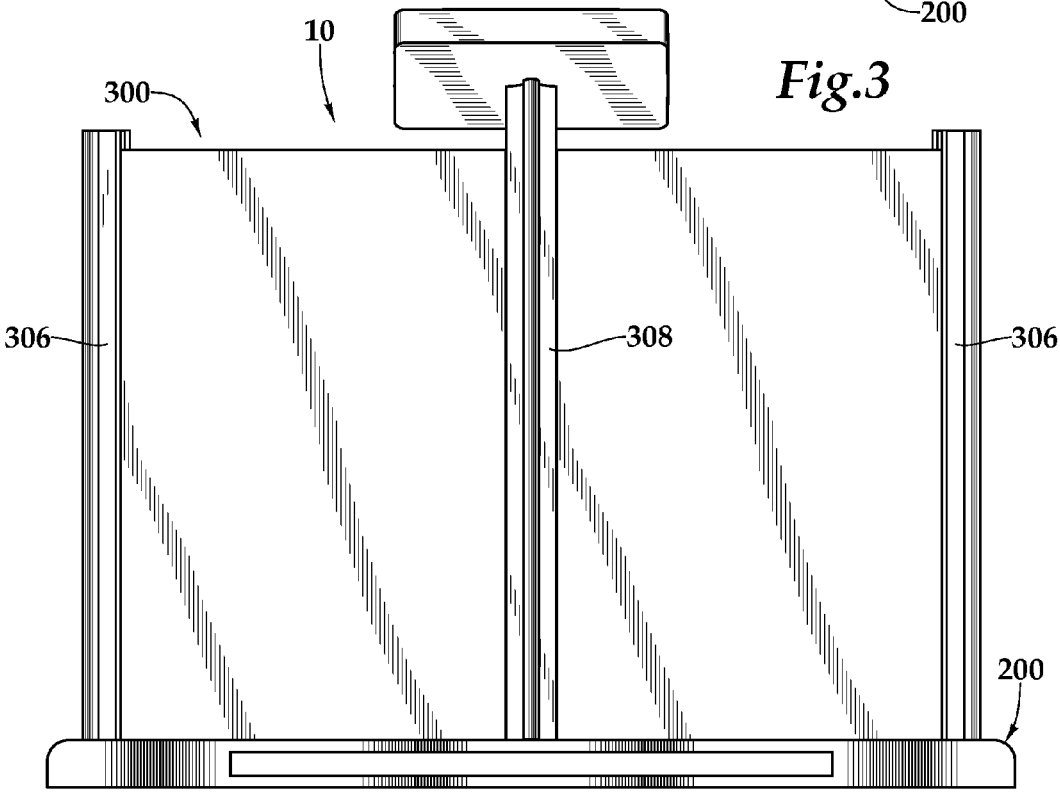
FIG. 3 is a rear view of the game apparatus shown in FIG. 1A.

Furthermore, openings 154 may have any shape. Additionally, as shown in FIG. 1A, the distance between each opening 154 may be substantially the same. In another embodiment, the distance between openings 154 may not be the same, which may increase the difficulty of the game.

Figure 5:
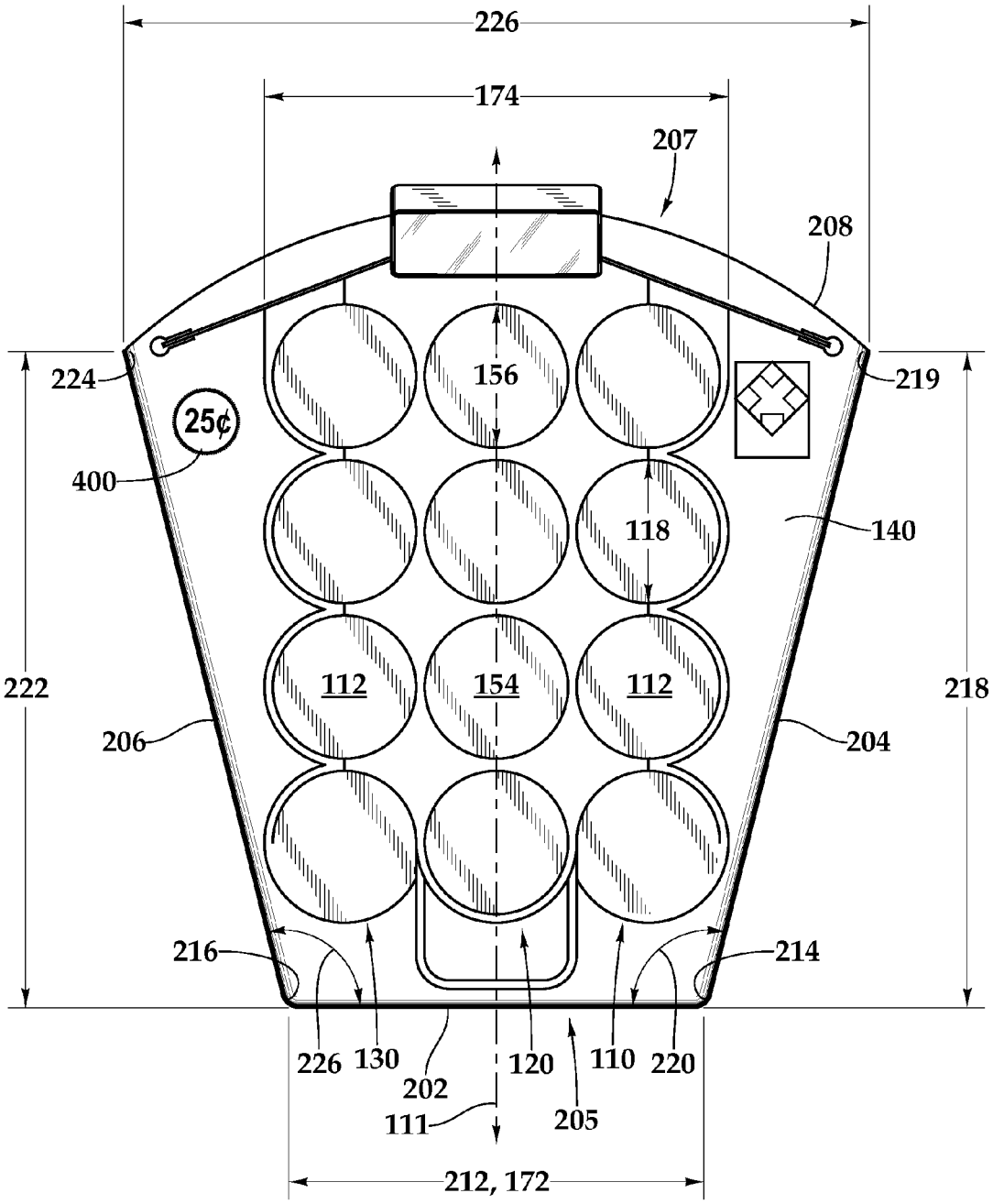
FIG. 5 is a top view of the game apparatus shown in FIG. 1A.
Figure 6:
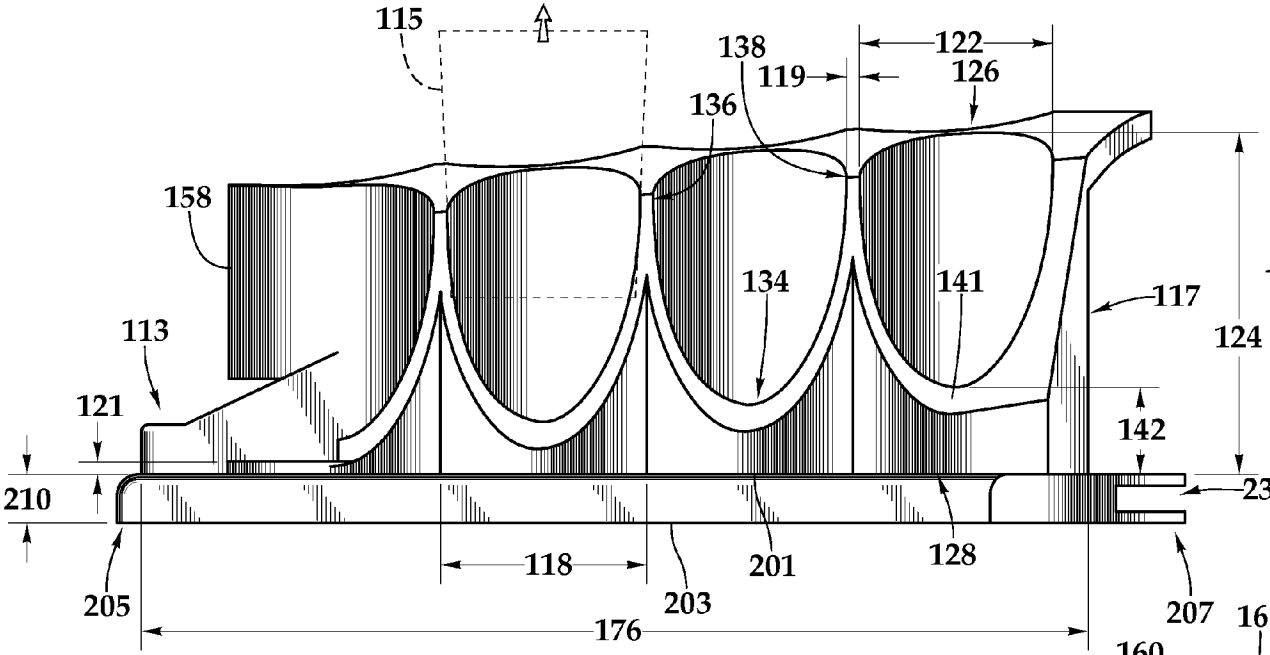
FIG. 6 is a side view of the game apparatus shown in FIG. 1A, without a backboard.
Figure 7:
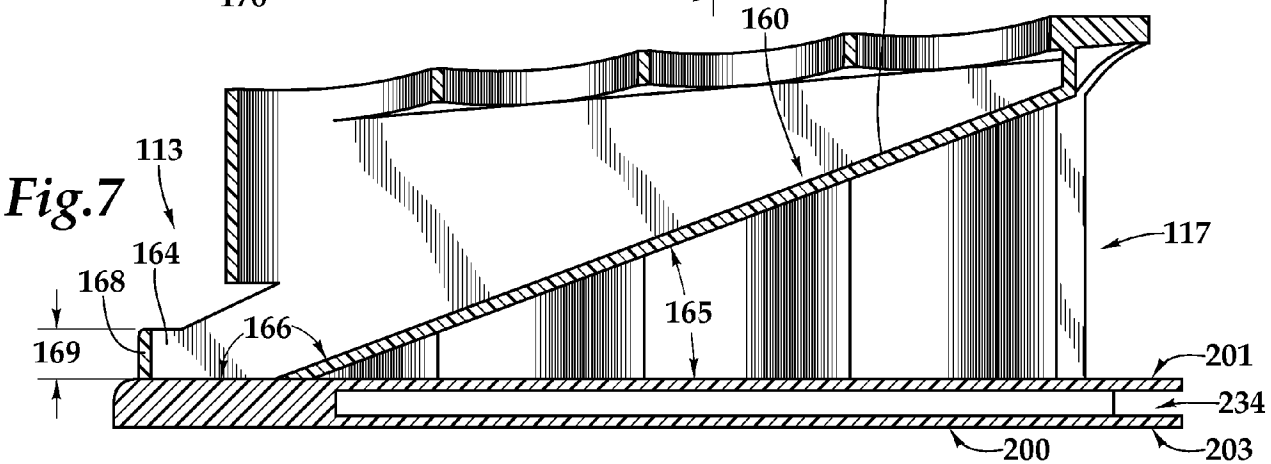
FIG. 7 is a cross-sectional view of the game apparatus shown in FIG. 1A, without a backboard.
Figure 8:
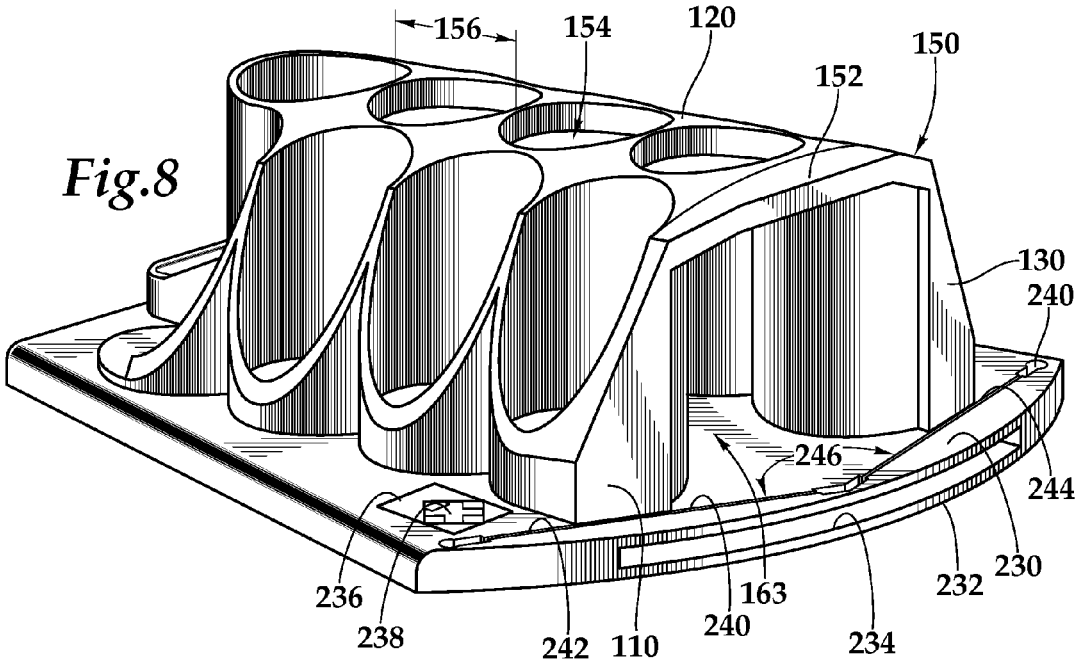
FIG. 8 is a perspective rear view of the game apparatus shown in FIG. 1A, without a backboard.
Figure 9:
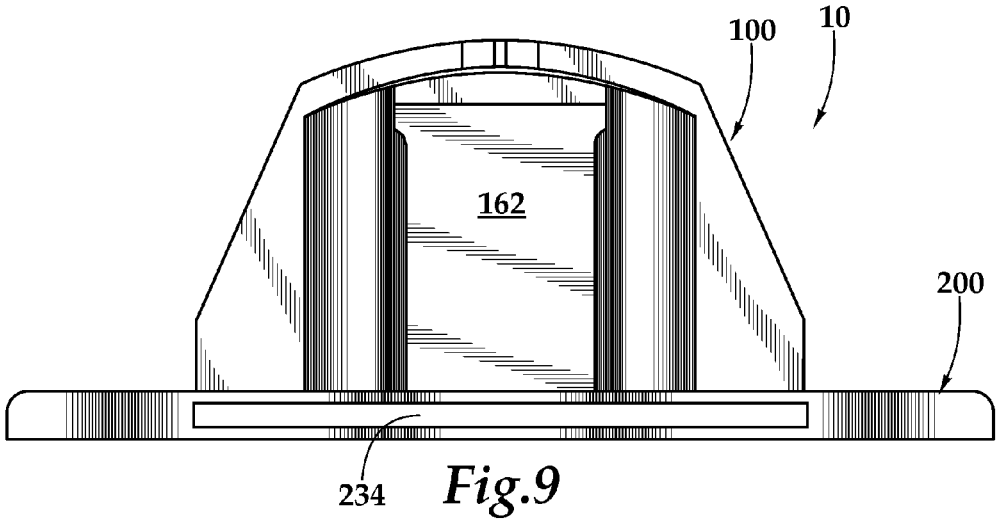
FIG. 9 is a rear view of the game apparatus in FIG. 1A, without a backboard.

As shown in FIG. 5, openings 154 of second column 120 and cup receptacles 112 of first and third columns 110 and 130 may form a matrix having rows and columns. Openings 154 and cup receptacles 112 form columns that are substantially parallel with respect to one another and with axis 111. Similarly, openings 154 and cup receptacles 112 also form rows that are substantially parallel with respect to one another, and the rows are substantially perpendicular to axis 111. In an alternative embodiment, openings 154 and cup receptacles 112 may have any positioning.

Bottom portion 160 may include at least one ramp or surface 162. Surface 162 facilitates returning game playing member 400 to front end 113, as will be described in more detail herein. In one embodiment, surface 162 extends proximate front end 113 to couple to portion 152 proximate rear end 117. Surface 162 is angled such that an angle 165 is defined between surface 162 and game playing surface 200. In one embodiment, angle 165 is an acute angle. For example, angle 165 may be between about 5 degrees and about 80 degrees, preferably between about 15 degrees and about 50 degrees, and in one embodiment about 21 degrees. Because surface 162 is angled, an opening 163 may be defined underneath second portion 120 of game playing body 100.

Moreover, bottom portion 160 may include an extension surface 164 that extends outward from surface 162 proximate front end 113. Specifically, surface 164 is configured to be substantially co-planar with game playing surface 200. Moreover, an angle 166 may be defined between surface 162 and surface 164 where angle 166 may be an obtuse angle. Furthermore, a flanged portion 168 may extend a distance 169 upward from the periphery of surface 164. Flanged portion 168 may also extend upward from a portion of the periphery of ramp 162 to facilitate retaining game playing member 400 within game playing body 100.

Game playing body 100 may have an arcuate shape proximate rear end 117 to facilitate engaging game playing backboard 300.

Base portion 140 of body 100 is configured to provide a substantially planar surface to engage and/or abut game playing surface 200 to facilitate stability of body 100. Base portion 140 may be coupled to at least one of bottom portion 160 and/or receptacle bases 114. Specifically, at least one tab, flange, peg, or other attachment extends outward from base portion 140, receptacle bases 114, and/or bottom portion 160. The at least one attachment is configured to engage game playing surface 200 to prevent body 100 from moving and/or shifting with respect to surface 200.

Game playing body 100 has a width 172 proximate front end 113 and a width 174 proximate rear end 117. In one embodiment, widths 172 and 174 are substantially the same. For example, widths 172 and 174 may be approximately 13". However, width 174 may be greater than width 172. Moreover, a length 176 may be defined between front end 113 and opposing rear end 117. For example, length 176 may be approximately 21". Furthermore, body 100 has a height 178 proximate front end 113 and a height 180 proximate rear end 117, wherein height 178 is preferably greater than height 180.

Game Playing Surface 200

Game playing surface 200 may be a substantially planar surface with the periphery defined by a plurality of edges. In one embodiment, surface 200 may be unitarily formed of a plastic material that is injection molded. In another embodiment, surface 200 may be formed as a first surface 201 and a second surface 203 that are configured to be coupled together. In another embodiment, surface 200 may be fabricated from any suitable material. For example, surface 200 may be fabricated of plastic, metal, paper, wood, laminate, glass, and/or any combination thereof.

Surface 200 may have a front end 205 and an opposing rear end 207. In one embodiment, surface 200 has four peripheral edges 202, 204, 206, and 208. Edge 202 is proximate front end 205 and is defined by a distance 212 extending between a first end 214 and an opposing second end 216. In one embodiment, distance 212 is greater than width 172. Edge 204 extends outward a distance 218 from first end 214 to an end 219 defining an angle 220 between edges 202 and 204. In one embodiment, distance 218 of edge 204 may be greater than distance 212 of edge 202. Similarly, edge 206 extends outward a distance 222 from second end 216 to an end 224 defining an angle 226 between edges 202 and 206. In one embodiment, distance 218 and distance 222 may be substantially equal. In one embodiment, edge 208 is proximate rear end 207 and is substantially arcuate extending a distance 226 between end 219 and end 224. Distance 226 may be greater than distances 212, 218, and 222. In one embodiment, each edge 202, 204, 206, and 208 is a bowed or a curved edge. In another embodiment, distances 212, 218, 222, and 226 may change to change the size of surface 200. For example, distance 212 may be approximately 13" and distances 218 and 222 may be approximately 23".

Moreover, surface 200 may have a thickness 210 defined between an upper surface 230 and a lower surface 232. Upper surface 230 and lower surface 232 may be fabricated such that an opening 234 is defined between surfaces 230 and 232 proximate rear end 207. In one embodiment, upper surface 230 and lower surface 232 are formed unitarily. In another embodiment, surfaces 230 and 232 are formed separately and subsequently coupled together.

Game playing surface 200 may have any suitable color. For example, surface 200 may be fabricated of a green color such that surface 200 resembles grass on a baseball field. In one embodiment, a bases member 236 is coupled to surface 200, particularly to surface 230, to keep track of the base position of each player, the outs, the runs, etc., similar to a baseball game to facilitate playing of the game. Bases member 236 may be positioned within surface 230 such that member 236 is substantially flush with surface 230. Bases member 236 may be fabricated of a white-board material that easily enables players to draw on member 236 and easily erase and/or clean the member 236. Alternatively, bases member 236 may be fabricated from any material. Preferably, it is fabricated from a material that can be written on. For example, bases member 236 may be fabricated from paper or chalk board or dry erase board. Moreover, bases member 236 may include a baseball diamond 238 drawn on member 236. In a further alternative embodiment, bases member 236 may be an electronic member that enables member 236 to automatically keep track of what base each team member or game player is on.

Surface 200 may also include at least one opening (not shown) defined within upper surface 230 configured to receive the attachment to prevent movement of body 100 with respect to surface 200 and to facilitate proper placement of body 100 with respect to surface 200. In one embodiment, receptacle front end 113 is positioned proximate surface front end 205, and body 100 is substantially centered between ends 214 and 216 of edge 202.

Surface 200 may further include at least one opening (not shown) configured to receive a mechanism that lights up. For example, a post may be inserted into such an opening wherein the post has a light at one end for shining light onto apparatus 10.

Furthermore, in one embodiment, game playing surface 200 may be configured to fold to facilitate ease of transport and/or storage. Specifically, game playing surface 200 may fold along a perforated or hinged fold (not shown) along axis 111. The hinged fold may be such that at least one hinge is coupled to a portion of lower surface 232 to facilitate folding surface 200. In another embodiment, game playing surface 200 may be formed as two separate portions that may separate along the perforated or hinged fold.

Moreover, game playing surface 200 may include at least one handle (not shown) coupled thereto to facilitate transporting and/or carrying apparatus 10 and/or surface 200.

To prevent apparatus 10 from moving on the surface in which it is placed, surface 200 may include at least one grip, pad, or other mechanism on lower surface 232. Moreover, a plurality of legs (not shown) may be coupled to lower surface 232 to vary the height between the substantially horizontal surface in which the game is placed upon and game playing surface 200.

Game Playing Backboard 300

Game playing surface 200 may include at least one opening or slot 240 defined therein to facilitate retaining backboard 300. Slot 240 may be defined proximate rear end 207 such that when backboard 300 is inserted at least partially within slot 240, backboard 300 is adjacent and/or abuts at least a portion of body 100. In one embodiment, slot 240 may be defined by a first portion 242 and a second portion 244 with an angle 246 formed therebetween. In another embodiment, slot 240 may be curved or may be straight. Backboard 300 may have a shape that is similar to the shape of slot 240 such that backboard 300 may be inserted into slot 240. For example, if slot 240 is curved, backboard 300 is also curved.

Moreover, in one embodiment, slot 240 may have a thickness that varies. For example, one end of slot 240 may be thicker than another end of slot 240. Slot 240 is configured to retain backboard 300 substantially perpendicular to at least one of surface 200 and/or upper surface 230 such that backboard 300 facilitates retaining game playing member 400 on, near, and/or within apparatus 10 when the game is being played.

In one embodiment, backboard 300 may be formed of a paperboard material. In another embodiment, backboard 300 may be fabricated from any suitable material. For example, backboard 300 may be fabricated of metal, plastic, wood, laminate, glass, mesh, cloth, netting, and/or any combination thereof. Moreover, backboard 300 has a height 301 and a width (not shown), before backboard 300 is coupled to surface 200. Preferably, height 301 is greater than heights 178 and 180 of body 100, and the backboard width is greater than widths 172 and 174.

Moreover, in one embodiment, backboard 300 may be unitarily formed of a paperboard material with a fold or a hinge line. The fold line defines a first portion 302 and a second portion 304. In another embodiment, first portion 302 and second portion 304 may be fabricated separately and coupled together to form backboard 300.

At least one guard or support or post 306 may be coupled to at least one edge of backboard 300 to facilitate protecting the edges of backboard 300. Moreover, at least one additional guard 308 may be coupled to backboard 300 to facilitate holding backboard erect and substantially perpendicular to surface 200. Preferably, at least one guard 308 may be coupled to backboard 300. In one embodiment, guards 306 and 308 are yellow in color and resemble foul posts and/or centerfield posts.

Backboard 300 may include an image (not shown) printed or affixed thereon. The image may be an image of a back wall and stadium crowd from a baseball game to enhance the appearance of the game.

Moreover, backboard 300 may include openings therein to retain attachments. For example, backboard 300 may include an opening (not shown) defined therein to retain a cup that may be labeled "grand slam".

At least one scoring member 320 is configured to couple to backboard 300 and is configured to keep the score of the game. Scoring member 320 may include at least one fastening mechanism or clip configured to fasten scoring member 320 to a top portion of backboard 300. Preferably, scoring member 320 is coupled to the top portion of backboard 300. In another embodiment, scoring member 320 may be coupled to guard 308. Scoring member 320 may further include a display portion 324. Display portion 324 may include a table or scoring chart (not shown). The table may include a plurality of rows and a plurality of columns. For example, the table may include two rows, one each for the home team and the away team, and may include eight columns, one column for each of seven innings and one column for the total score.

Scoring member 320 may be fabricated of a white-board material that easily enables players to draw on member 320 and easily erase and/or clean the member 320. Alternatively, member 320 may be fabricated from any material that can be written on. For example, member 320 may be fabricated from paper, dry erase board, and/or chalk board. In another embodiment, member 320 may include a sliding mechanism, flip cards, magnets, and/or push buttons that enable a player to slide and/or move the same along and/or on member 320 to keep track of the score. In a further embodiment, display portion 324 of member 320 may include an electronic display portion 324 and may digitally display the scores for each team. In another embodiment, member 320 may be an electronic member that enables member 320 to automatically keep track of the score. When scoring member 320 includes electronic display portion 324 and/or member 320 is an electronic member, a power source (not shown) would be configured to power member 320. Backboard 300 may also include further attachments in addition to scoring member 320 that may facilitate game play.

Whether backboard 300 is a unitary member or includes more than one portion, backboard 300 is configured to fold. Once backboard 300 is folded, it may be inserted into opening 234 proximate rear end 207. Guards 306 and/or 308 may also be inserted and stored within opening 234. Moreover, scoring member 320 and/or other attachments may be inserted and stored within opening 163 defined beneath second portion 120 of body 100.

Game Playing Member 400

Game playing member 400 may be any member that can be tossed towards apparatus 10 and is preferably smaller than diameter 156 of each opening 154 such that game playing member 400 may be tossed into apparatus 10 through openings 154. Game playing member 400 is preferably a member that can tossed towards a surface and bounce towards apparatus 10. For example, game playing member 400 may be a metal slug such as a quarter. In one embodiment, game playing member 400 may be, but is not limited to being, other coin such as pennies or dimes, dice, a member fabricated from plastic, a member fabricated from wood, a member fabricated from paper, and/or any combination thereof.

Method of Use

Game playing apparatus 10 is a baseball-themed apparatus configured to facilitate playing a baseball-themed game. The baseball-themed game is played with at least two players or batters, a consumable liquid and/or food and/or a door prize (i.e., object), a plurality of cups 115, and a plurality of game playing members 400. To prepare to play the game, divide the at least two players into two teams and organize a batting order within each team. Determine which team is the visiting team, which will bat or play first, and the remaining team is the home team, which will bat or play second. Apparatus 10 should be placed on any table, countertop, or a substantially horizontal surface. Preferably, apparatus 10 is positioned approximately one foot from the edge of the table or countertop. In one embodiment, apparatus 10 is positioned on the floor. Also, in one embodiment, apparatus 10 is elevated and/or adjusted by a plurality of legs coupled to surface 232.

Once apparatus 10 is in position, at least one cup 115 is placed within each cup receptacle 112 within each portion 110 and 130. In another embodiment, at least one cup 115 may be placed within select cup receptacles 112 within portions 110 and 130. In one embodiment, cups 115 placed within portion 110 are considered the home team's cups and cups 115 placed within portion 130 are considered the visiting team's cups. Cups 115 within apparatus 10 are then filled with the chosen consumable liquid or food or door prize. Cups 115 may be labeled to prevent confusion between teams. Moreover, different color cups may be used to prevent confusion. Also, cups 115 may be of varying sizes depending on multiple factors such as the size of apparatus 10, the size of cup receptacles 112, and the liquid or food or door prize being used to play the game.

To begin playing the game, a first player on the visiting team stand near the edge of the table and/or counter and tosses game playing member 400 towards the table and/or counter in an attempt to bounce game playing member 400 on the table and/or counter such that member 400 projects towards apparatus 10. In another embodiment, member 400 is tossed directly towards apparatus 10, without bouncing member 400.

The goal of bouncing member 400 on the table and/or counter is to land member 400 within at least one opening 154 within second portion 120 wherein each opening 154 may be labeled with at least one of single, double, triple, and home run. If the player bounces member 400 into one of openings 154, member 400 will slide down surface 162 of bottom portion 160 towards front end 113 where substantially planar surface 164 and flanged portion 168 will retain game playing member 400. Moreover, if the player bounces member 400 into one of openings 154, the opposing team must consume the liquid and/or food and/or remove the door prize within the cup 115 (labeled for their team) that is in the cup receptacle 112 that is beside the opening 154 that member 400 landed within. Moreover, the opposing team must consume the liquid and/or food and/or remove the door prize within the cups 115 that are positioned between front end 113 and the cup 115 next to the opening 154 that member 400 landed within. For example, if a home team player bounces member 400 into opening 154 labeled "triple", then the visiting team is to consume the food and/or liquid and/or remove the door prize within the visiting team's cup 115 next to the opening labeled "single", the visiting team's cup 115 next to the opening labeled "double", and the visiting team's cup 115 next to the opening labeled "triple". Moreover, if the player gets a "triple", then it is recorded. However, if each team only has one player, the player only consumes the liquid and/or food and/or removes the door prize within the cup 115 that is positioned next to the opening 154 that member 400 landed within. Similarly, if the player bounces member 400 into the "grand slam" cup coupled to backboard 300, then the opposing team must consume all cups 115 for both the visiting and the home team.

On the other hand, if the player does not bounce member 400 into one of the openings 154, an out is recorded. If the player tosses member 400 into one of the cups 115, an out is recorded and the batting team (or the team in which the most recent player that just tossed member 400 towards apparatus 10) must drink and/or eat the liquid and/or food and/or remove the door prize within the cup 115 that member 400 landed in. Once that cup 115 is emptied of the liquid and/or food and/or door prize, cup 115 is refilled and repositioned within cup receptacle 112.

While the game is being played, the score, the runs, and the outs are all tallied and kept track of on at least one of the scoring member 320 and/or the bases member 236. If one team gets three outs, the teams switch. In other words, the players from the other team are to toss member 400 or are "up to bat". Once each team has batted, the next inning begins. The team with the most runs recorded after a predetermined number of innings, e.g., after seven innings, wins the game. If there is a tie, the players choose how to settle the game. For example, additional innings may be played. In another embodiment, the game is won when a predetermined event occurs.

The apparatus of the present invention provides a game playing apparatus that is easy to use, that is cost-effective, and has increased functionality. Specifically, the present invention provides an apparatus to facilitate the playing of a baseball themed game. Moreover, the present invention provides a game apparatus that may be used with other similar games including, but not limited to, other sports games such as football.

Game Apparatus 1000

In another embodiment discussed herein, referring to FIGS. 1 and 10-17, a game playing apparatus 1000 is a baseball-themed apparatus configured to facilitate playing a baseball-themed game. Similar to apparatus 10 of FIGS. 1A-9, apparatus 1000 may include a game playing body or a body 1100, a game surface or a surface 1200, a game playing backboard or a backboard 1300, and/or a scoreboard or scoring member 1320. A player plays with apparatus 1000 in substantially the same way as when a player plays with apparatus 10, shown in FIGS. 1A-9.

Game Playing Body 1100

In another embodiment, referring to FIGS. 1 and 10-17, game playing body 1100 may receive a game playing member 1400 and is configured to couple to game playing surface 1200. In one embodiment, body 1100 may be fabricated from a plastic material that is injection molded. Preferably, body 1100 is fabricated of plastic having a thickness between about 1/16" and about 1/2", and more preferably between about 1/8" and about 1/3", and in one example about 1/4". In an alternative embodiment, body 1100 may be fabricated from any suitable material. For example, body 1100 may be fabricated from, but not limited to being fabricated from, metal, paper, nylon, polycarbonate, polyester, polyethylene, polypropylene, wood, laminate, glass, stainless steel, ceramics, and/or any combination thereof that facilitates the functionality of body 1100. In another embodiment, rather than body 1100 being a unitary member, body 1100 may be formed of portions and coupled together. Body 1100 may be of a chosen color to reduce and/or inhibit thermal communication. For example, body 1100 may be fabricated specifically from tan colored plastic rather than black colored plastic to reduce the retention of heat within body 1100.

Figure 12:
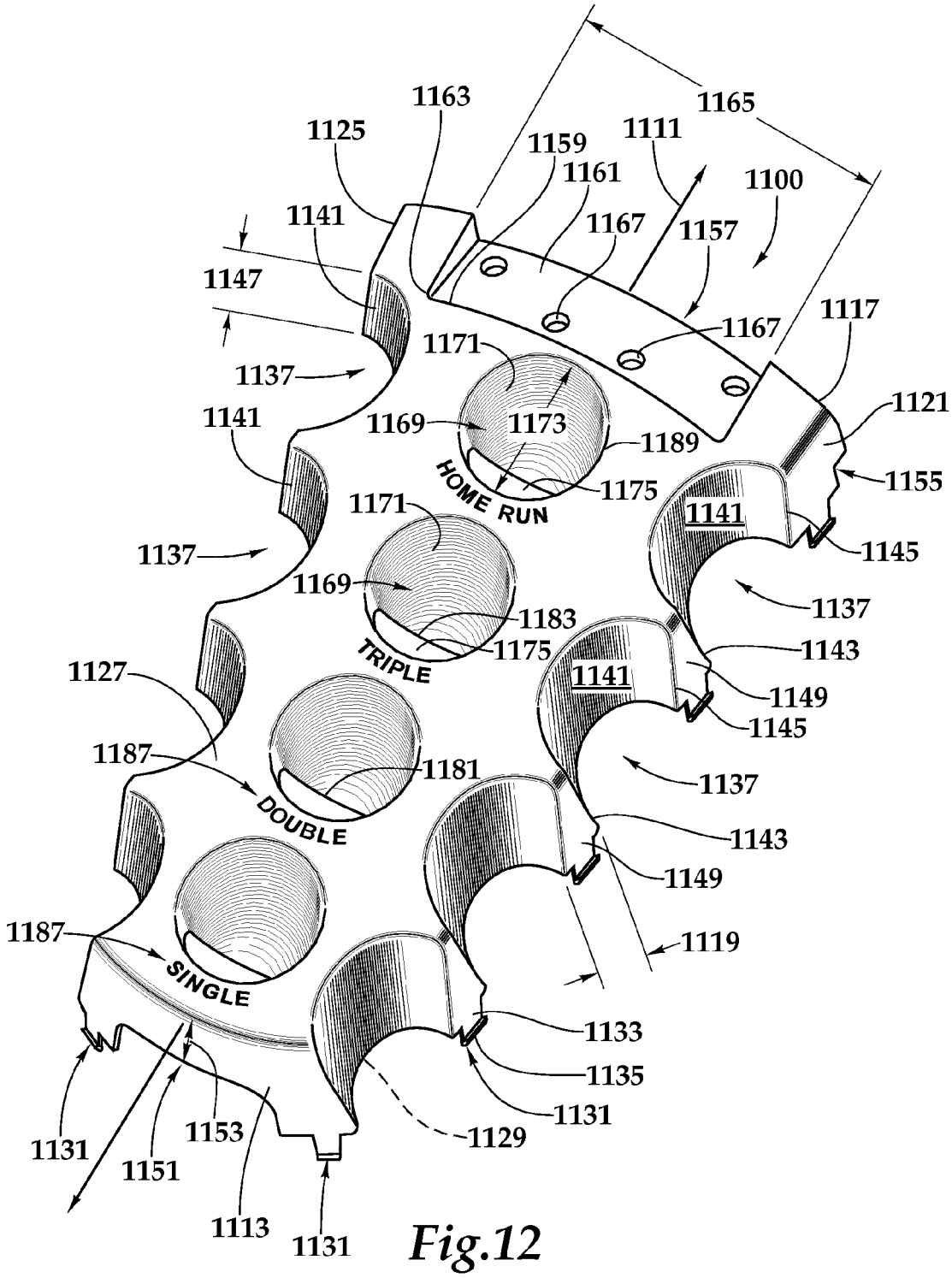
FIG. 12 is a perspective view of a game playing body shown in FIG. 1.
Figure 15:
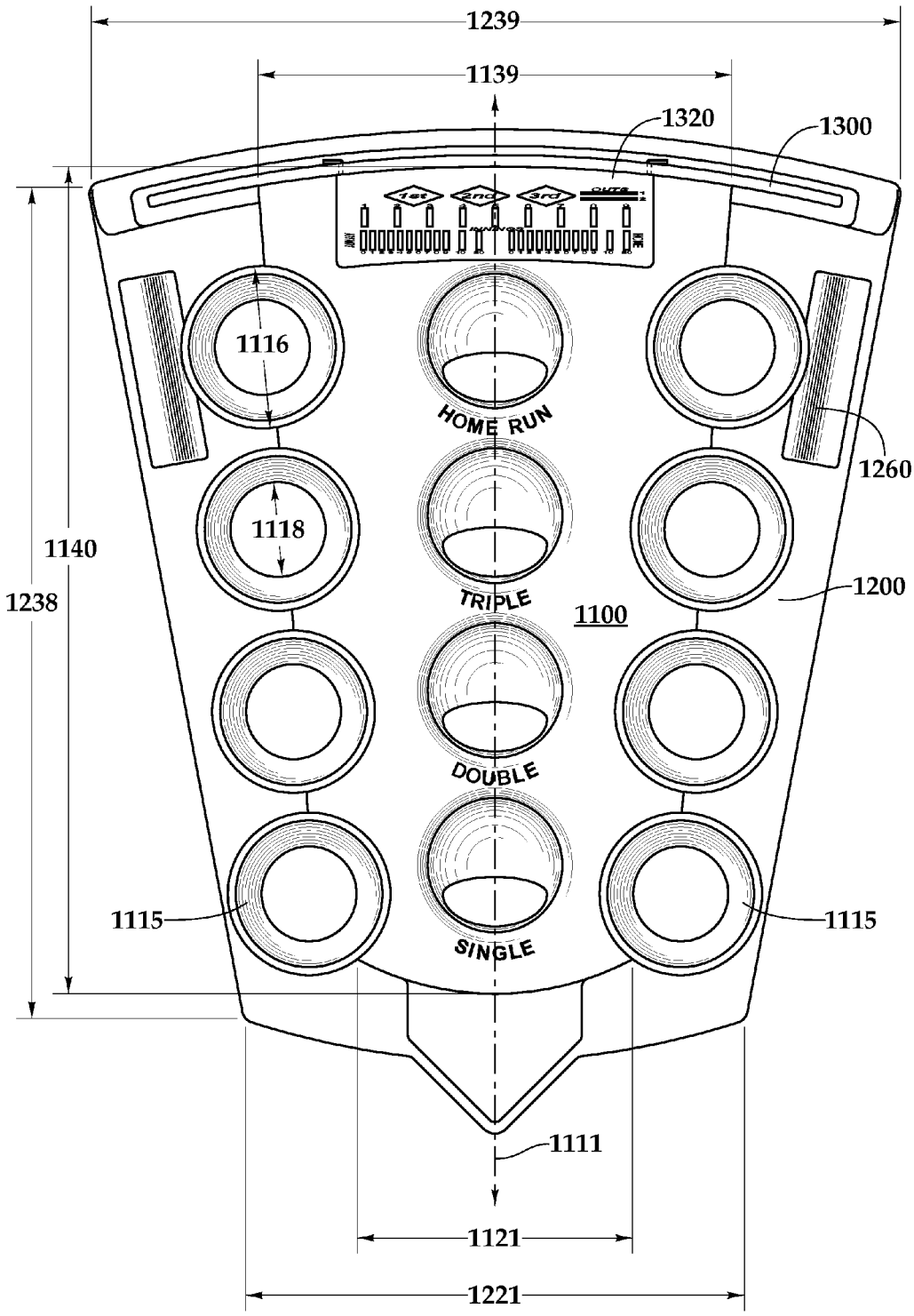
FIG. 15 is a top view of the game apparatus shown in FIG. 1.

As shown in FIG. 12, body 1100 has a front surface 1113, an opposing rear surface 1117, a first surface or first side 1123, an opposing second surface or second side 1125, a top surface 1127 and a bottom surface 1129. An axial plane 1111, shown in FIGS. 12 and 15, is defined between front surface 1113 and rear surface 1117. In one embodiment, body 1100 is a substantial minor image of itself about axial plane 1111. Top surface 1127 is configured to facilitate game playing member 1400 into either receptacles 1169 or into cups 1115.

Front surface 1113 has a length 1121, also shown in FIG. 15, and rear surface 1117 has a length 1139. Length 1139 may be greater than length 1121. Moreover, front surface 1113 and rear surface 1117 may be arcuate surfaces. Specifically, front surface 1113 may be convex, and, similarly, rear surface 1117 may be convex.

Length 1121 may be between about 2" and about 15", preferably between about 3" and about 10", and in one embodiment about 5½". Additionally, length 1139 may be between about 2" and about 15", preferably between about 3" and about 10", and in one embodiment about 8¾".

Also, body 1100 may have a length 1140 defined between surfaces 1113 and 1117. Length 1120 may be between about 5" and about 20", preferably between about 10" and about 18", and in one embodiment about 15½".

Body 1100 includes a plurality of indentations 1137. Indentations 1137 are configured to align with a plurality of cup receptacles or a plurality of receptacles 1212, which are part of game playing surface 1200 and are discussed herein. Together, indentations 1137 and receptacles 1212 are configured to receive a plurality of cups 1115 therein.

Cups 1115 may have varying size and shape, and may be fabricated from various materials. Each cup 1115 may have a first diameter 1116 proximate a top of cup 1115 and a second diameter 1118 proximate a bottom of cup 1115, wherein the first diameter may be greater than the second diameter, such that cup 1115 tapers between the top and the bottom. Alternatively, first diameter 1116 and second diameter 1118 may be substantially equal, or second diameter 1118 may be greater than first diameter 1116. In one embodiment, cups 1115 are similar in size and are plastic to prevent cups 1115 from breaking while apparatus 1000 is in use.

Each cup 1115 may be configured to contain between about 0.5 ounces of liquid and about 40 ounces of liquid, preferably between about 1 ounce of liquid and about 32 ounces of liquid, and in one embodiment about 9 ounces of liquid. For example, each cup 1115 may be a Hefty Easy Grip 9 oz. Party Cup.

Cups 1115 may vary in height. Each cup 1115 may be between about 1" tall and about 15" tall, preferably between about 5" tall and about 12" tall, and in one embodiment about 3¼" tall.

Turning to cup diameters 1116 and 1118, diameter 1116 may be between about 1" and about 8", preferably between about 2" and about 5", and in one embodiment about 3⅛".

Diameter 1118 may be between about 1" and about 15", preferably between about 5" and about 12", and in one embodiment about 1⅞". For example, each cup 1115 may be a Hefty Easy Grip 9 oz. Party Cup.

In one embodiment, indentations 1137 may be defined within first surface 1123 and within second surface 1125. Specifically, four indentations may be defined within first surface 1123 and four corresponding indentations may be defined within second surface 1125. Also, indentations 1137 defined within first surface 1123 may be parallel with indentations 1137 defined within second surface 1125.

Each indentation 1137 may have a concave wall 1141 extending between a first generally vertical edge 1143 and a second generally vertical edge 1145, wherein each indentation has a radius of curvature. The radius of curvature may be substantially the same as diameter 1222 or may be substantially the same as diameter 1116 of cup 1115. Each wall 1141 has a height 1147 defined between top surface 1127 and bottom surface 1129. Moreover, each wall 1141 may have a smooth surface. Alternatively, each wall 1141 may have one or more notches (not shown) to facilitate retaining a cup 1115 in place. Further, each wall 1141 may have at least one slot formed therein to facilitate releasing condensation that may collect on wall 1141 from cup 1115.

Additionally, a partition 1149 is defined between each respective indentation 1137. Each partition 1149 may extend between top surface 1127 and bottom surface 1129 and may have a thickness 1119. Thickness 1119 may vary between top 1127 and bottom 1129. In one embodiment, as shown in FIG. 12, thickness 1119 tapers between bottom 1129 and top 1127, such that thickness 1119 is greater at bottom 1129 than at top 1127.

Body 1100 further may include a plurality of flanges or clips 1131 configured to engage game playing surface 1200. Each clip 1131 may extend downward. In one embodiment, body 1100 includes ten clips 1131, wherein one clip 1131 extends downward from each of the six partitions 1149 proximate bottom surface 1129, two clips 1131 extend downward from front surface 1113, and two clips 1131 extend downward from rear surface 1117. Each clip 1131 may have a height and include a first portion 1133 extending from bottom surface 1129 and a second portion 1135 extending from first portion 1133. In one embodiment, second portion 1135 is thicker than first portion 1133, such that second portion 1135 may create a protrusion to engage game playing surface 1200.

Moreover, front surface 1113 has a cutout portion or arch 1151 formed therein. Arch 1151 may form an opening, shown in FIG. 1, with game playing surface 1200. A height 1153 is defined between top of arch 1151 and top surface 1127.

A first fillet 1155 is formed in first side 1123 and a second fillet (not shown) is formed in second side 1125. First fillet 1155 and second fillet may be formed proximate rear surface 1117 of body 1100. Moreover, first fillet 1155 and second fillet may have radii of curvature substantially equal with a radius of curvature of game playing surface 1200 in order to interface with surface 1200.

Additionally, a ledge 1157 is formed in top surface 1127 proximate rear surface 1117 of body 1100 having a first generally vertical surface 1159 and a second surface 1161. First and second surfaces 1159 and 1161 may form an intersection 1163. In one embodiment, second surface 1161 slopes downward away from intersection 1163. Ledge 1157 has a length 1165. Length 1165 may be less than length 1139 of rear surface 1117 of body 1100. Depressions 1167 may be defined within second surface 1161 and are configured to receive at least a portion of scoring member 1320. In one embodiment, four depressions 1167 are defined within second surface 1161. As shown in FIG. 12, depressions 1167 may be generally arcuately spaced, although other configurations such as a linear separation or staggering are possible.

Body 1100 further includes a plurality of receptacles 1169, wherein each receptacle 1169 is configured to receive a game playing member 1400. Receptacles 1169 may be generally parallel to and aligned with axial plane 1111. In one embodiment, four receptacles are defined within top surface 1127 and are spaced equidistant from one another. Each receptacle 1169 may have a generally circular ingress 1171, having a diameter 1173 and a perimeter 1189, and an egress 1175. Diameter 1173 may be substantially the same as diameter 1222 of receptacle 1212. Diameter 1173 of receptacle 1169 may be between about 0.5" and about 6", and more preferably between about 1" and about 5", and in one embodiment about 3". Alternatively, diameter 1173 is smaller than diameter 1222.

Figure 16:
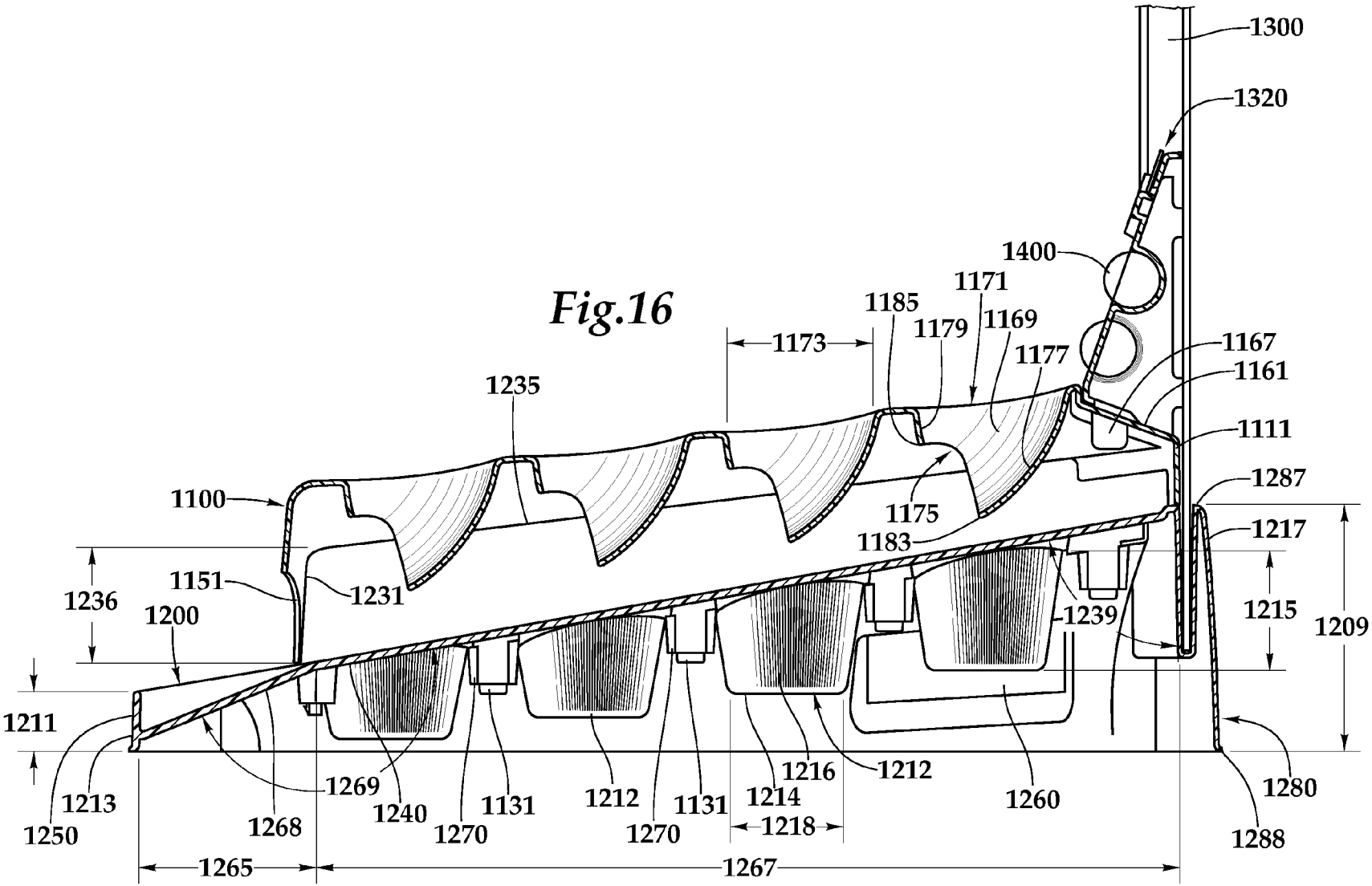
FIG. 16 is a cross-sectional side view of the game apparatus shown in FIG. 1.
Figure 17:
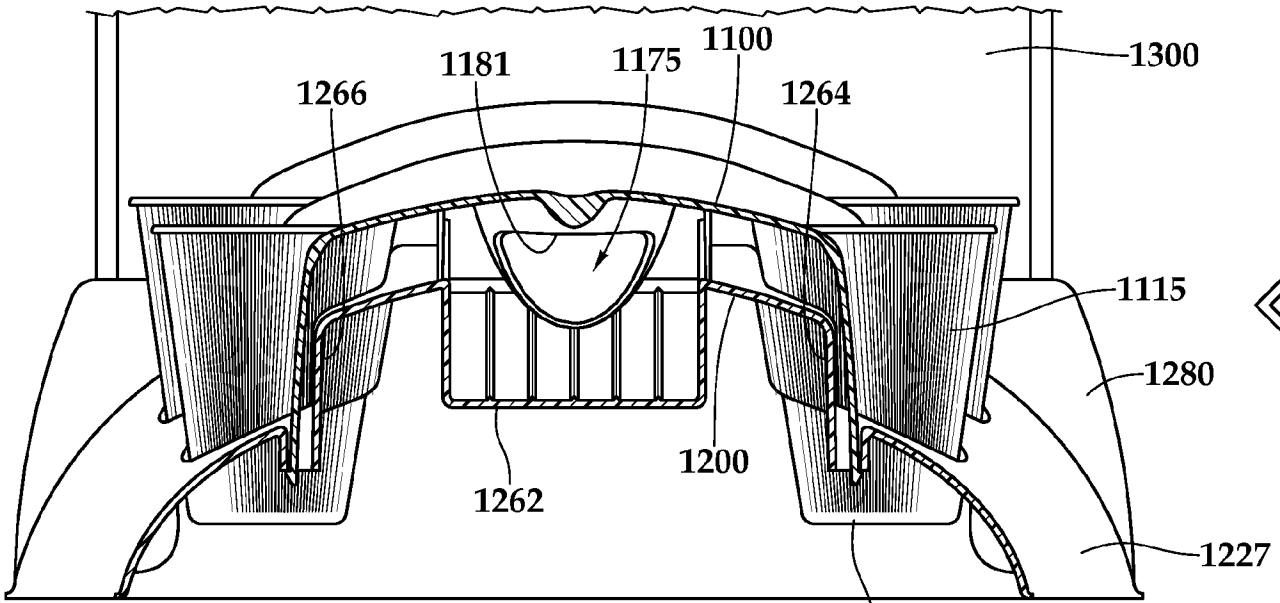
FIG. 17 is a cross-sectional front view of the game apparatus shown in FIG. 1.

Turning to FIG. 16, each receptacle 1169 may have a curved or inclined rear surface 1177 extending downward from ingress 1171 to facilitate returning of game playing member 1400. Each receptacle 1169 also may have a curved or inclined front surface 1179 extending downward from ingress 1171 to facilitate guiding of game playing member 1400 toward curved rear surface 1177. Curved rear surface 1177 may have a first radius of curvature and curved front surface 1179 may have a second radius of curvature. The second radius of curvature may be generally constant. The first radius of curvature may be substantially equal to the second radius of curvature of curvature at ingress, and the first radius of curvature may decrease from ingress into receptacle. Curved surfaces 1177 and 1179 may form a perimeter 1181 of egress 1175. Specifically, a lower edge 1183 of curved rear surface 1177 and a lower edge 1185 of curved front surface 1179 may define perimeter 1181, as shown in FIG. 17.

A plurality of labels 1187 may be coupled to or formed within top surface 1127 of body 1100. Each label 1187 may be proximate a receptacle 1169. For example, a plurality of labels 1187 that progressively read "single", "double", "triple", and/or "home run" may be positioned on top surface 1127. Label 1187 that reads "single" may be positioned closest to front surface 1113, and label 1187 that reads "home run" may be positioned closed to rear surface 1117.

Game Playing Surface 1200

Further referring to FIGS. 1 and 10-17, game playing apparatus 1000 also includes game playing surface 1200. In one embodiment, surface 1200 may be unitarily formed of a plastic material that is injection molded. Surface 1200 may be fabricated of plastic having a thickness between about 1/16" and about 1/2", and more preferably between about 1/8" and about 1/3", and in one embodiment about 1/4". In another embodiment, surface 1200 may be formed as portions and coupled together. In an alternative embodiment, surface 1200 may be fabricated from any suitable material. For example, surface 1200 may be fabricated from, but not limited to being fabricated from, metal, paper, nylon, polycarbonate, polyester, polyethylene, polypropylene, wood, laminate, glass, stainless steel, ceramics, and/or any combination thereof that facilitates the functionality of surface 1200. Similar to body 1100, surface 1200 may be of a chosen color. For example, surface 1200 may be fabricated specifically from green colored plastic to resemble the color of grass on a baseball field.

Figure 11:
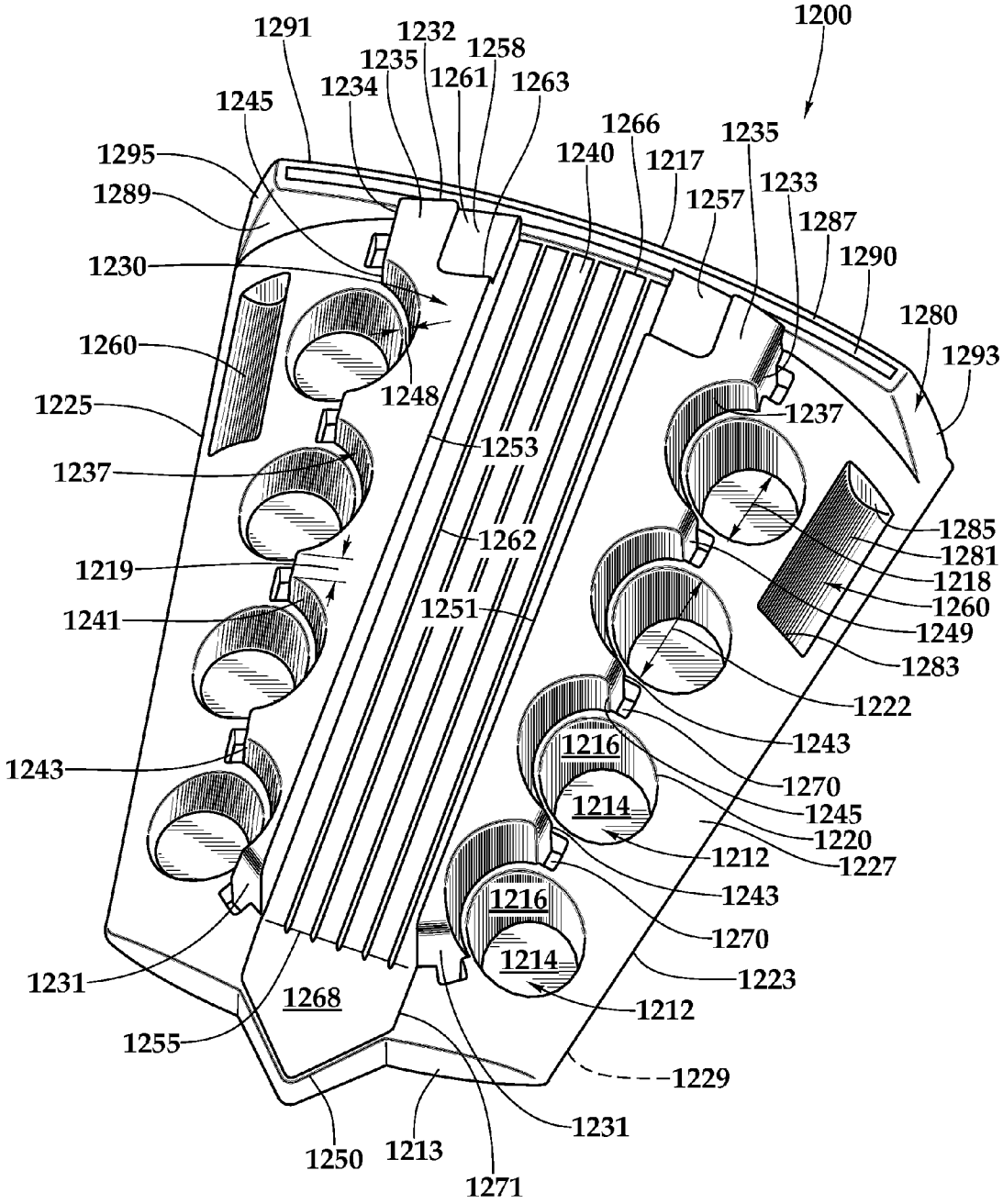
FIG. 11 is a perspective view of a game surface shown in FIG. 1.

As shown in FIG. 11, surface 1200 has a front surface or edge 1213, an opposing rear surface or edge 1217, a first side edge 1223, an opposing second side edge 1225, a top surface 1227 and a bottom surface 1229.

As shown in FIG. 15, front surface 1213 has a length 1221, and rear surface 1217 has a length 1239. Length 1239 may be greater than length 1221. Length 1221 may be between about 3" and about 20", preferably between about 5" and about 15", and in one embodiment about 9 1/4". Additionally, length 1239 may be between about 3" and about 25", preferably between about 4" and about 20", and in one embodiment about 15". Moreover, surface 1200 has a length 1238 defined between front surface 1213 and rear surface 1217. Length 1238 may be between about 3" and about 30", preferably between about 4" and about 25", and in one embodiment about 16".

As shown in FIG. 15, sides 1223 and 1225 may be positioned such that each side 1223 and 1225 are angled with respect to axial plane 1111 and may intersect at a point not shown on FIG. 15. Furthermore, length 1239 may be greater than length 1139 of body 1100, and length 1221 may be greater than length 1121 of body 1100. Moreover, rear surface 1217 may be an arcuate surface. Specifically, rear surface 1217 may be a convex surface.

As shown in FIG. 16, front surface 1213 has a height 1211 and rear surface 1217 has a height 1209. Height 1209 may be greater than height 1211. Moreover, as shown in FIG. 11, top surface 1227 may be an arcuate surface. For example, as shown in FIG. 17, top surface 1227 may have a convex shape extending between first edge 1223 and second edge 1225. Additionally, surface 1227 may slope upward between surface 1213 and surface 1217.

Returning to FIG. 11, surface 1200 may include a plurality of cup receptacles, holders or depressions 1212, a center portion 1230 with a return surface 1240, a front ledge 1250, at least one game playing member receptacle 1260, at least one clip opening 1270, and a rear ledge 1280 with a rear indentation 1290.

Plurality of cup receptacles 1212 may be defined within surface 1227. Each cup receptacle 1212 is configured to facilitate receiving and/or retaining a cup 1115, shown in FIG. 1, therein.

In one embodiment, as shown in FIG. 11, surface 1200 includes four receptacles 1212 proximate first edge 1223 and four receptacles 1212 proximate second edge 1225, wherein receptacles 1212 may be spaced with an equal distance between them. Alternatively, surface 1200 may include any number of receptacles. Each cup receptacle 1212 may graduate in height between front surface 1213 and rear surface 1217, because height 1211 of surface 1213 is less than height 1209 of surface 1217.

Each cup receptacle 1212 may include a base 1214 and a sidewall 1216. Each base 1214 may have a substantially round shape with a diameter 1218. In one embodiment, diameter 1118 of cup 1115 is slightly smaller than diameter 1218, such that cup receptacle 1212 is configured to receive cup 1115. Alternatively, base 1214 may have any suitable shape that facilitates retaining a cup 1115. Each base 1214 also may include an opening (not shown) defined therein to expel moisture that may accumulate within base 1214 from each cup 115.

Each sidewall 1216 may have a cylindrical shape and may extend upward from base 1214. Alternatively, sidewall 1216 may have any suitable shape that facilitates retaining a cup 1115. Additionally, a diameter 1222 may be defined proximate the top of sidewall 1216, i.e., proximate surface 1227. Diameter 1222 may be approximately equal to diameter 1218, shown in FIGS. 11 and 16. Alternatively, diameter 1222 may be greater than diameter 1218 such that each sidewall 116 tapers between top surface 1227 and base 1214, such that tapered sidewalls 116 may facilitate an increased ability to retain cups 1115.

Further, each sidewall 1216 may have a height 1215, shown in FIG. 16, defined between top surface 1227 and base 1214. Height 1215 of receptacle 1212 proximate rear surface 1217 may be less than height 1215 of receptacle 1212 proximate front edge 1213. As such, the height 1215 of one cup receptacle 1212 within game playing surface 1200 may be different than the height 1215 of another cup receptacle 1212 within game playing surface 1200.

An intersection 1220 is defined by each sidewall 1216 and top surface 1227. Because top surface 1227 may be convex, each intersection 1220 may slope generally downward from center portion 1230 toward edge 1223 or each intersection 1220 may slope generally downward from edge 1225.

Continuing with FIG. 11, surface 1200 further includes center portion 1230. Center portion 1230 may include a front surface 1231, a rear surface 1232, a first surface 1233, a second opposing surface 1234, and a top surface 1235. In one embodiment, center portion 1230 is configured to mate with a portion of bottom surface 1129 of body 1100, wherein center portion 1230 provides support and stability for body 1100. Additionally, center potion 1230 may prevent body 1100 from moving and/or shifting while apparatus 1000 is in use.

Center portion 1230 may extend upward from surface 1227 and have a height 1236, shown in FIG. 16. Height 1236 may vary between front surface 1231 and rear surface 1232. In one embodiment, height 1236 proximate front surface 1231 is less than height 1236 proximate rear surface 1232.

Center portion 1230 may include a plurality of indentations 1237. Indentations 1237 are configured to align with indentations 1137 when bodies 1100 and 1200 are coupled together. In one embodiment, indentations 1237 may be defined within first surface 1233 and within second surface 1234. Specifically, four indentations may be defined within first surface 1233 and four corresponding indentations may be defined within second surface 1234.

In an alternative embodiment (not shown), surface 1200 does not include center portion 1230.

Returning to FIG. 11, each indentation 1237 may have a concave wall 1241 extending between a first or forward generally vertical edge 1243 and a second or aft generally vertical edge 1245 with a radius of curvature. Each wall 1241 has a height defined between top surface 1235 and surface 1227, wherein the height may be substantially the same as height 1236. Alternatively, indentations 1237 have varying heights. Moreover, each wall 1241 may have a smooth surface. Alternatively, each wall 1241 may have one or more notches (not shown) to facilitate engaging body 1100. A distance 1248 may be defined between a receptacle 1212 and an indentation 1237

Additionally, portion 1230 may include a partition 1249 defined between each respective indentation 1237. Each partition 1249 is configured to mate with partition 1149 when bodies 1100 and 1200 are coupled together. In one embodiment, each partition 1249 has the same characteristics, including shape, as each partition 1149.

Each partition 1249 may extend between top surface 1235 and surface 1227 and may have a thickness 1219. Thickness 1219 may vary between top surface 1235 and surface 1227. In one embodiment, thickness 1219 tapers, such that thickness 1219 is greater proximate surface 1227 than proximate top surface 1235.

Additionally, a first ledge 1257 and a second ledge 1258 may be formed in top surface 1227 proximate rear surface 1232. Ledges 1257 and 1258 may be configured to receive at least a portion of ledge 1157. Ledges 1257 and 1258 of body 1200 have first generally vertical surfaces 1259 and second surfaces 1261. First and second surfaces 1259 and 1261 may form intersections 1263. In one embodiment, second surfaces 1261 slopes downward away from intersections 1263.

Portion 1230 also may include return surface 1240 having a first edge 1251, a second edge 1253, a front edge 1255 and a rear edge 1266 and a length 1267. Return surface 1240 may extend between ledges 1257 and 1258 and further may be defined between four indentations 1237 within first surface 1233 and four indentations 1237 within second surface 1234.

Preferably, return surface 1240 may be angled such that an angle 1239 is defined between surface 1240 and surface 1289 of rear ledge 1280, as shown in FIG. 16. In one embodiment, angle 1239 is an acute angle. For example, angle 1239 may be between about 5 degrees and about 80 degrees, preferably between about 15 degrees and about 50 degrees, and in one embodiment about 30 degrees.

Additionally, return surface 1240 may include a plurality of ridges 1262 substantially parallel to axial plane 1111, wherein each ridge 1262 may extend between front surface 1231 and rear surface 1232. In one embodiment, return surface 1240 includes five ridges 1262 parallel to axial plane 1111 and spaced equidistant from one another.

As shown in FIG. 17, center portion 1230 may further include a first wall 1264 and a second wall 1266. Walls 1264 and 1266 and ridges 1262 may be configured to facilitate accelerating the return of game playing member 1400.

Returning to FIG. 11, game playing surface 1200 further may include an extension surface 1268. Extension surface 1268 may extend between front edge 1255 of return surface 1240 and front surface 1213 of body 1200. Also, extension surface 1268 may have a width substantially the same as surface 1240. Extension surface 1268 may intersect return surface 1240 proximate edge 1251 defining an obtuse angle 1269, shown in FIG. 16. For example, angle 1269 may be between about 150 degrees and about 180 degrees, preferably between about 160 degrees and about 170 degrees, and in one embodiment about 175 degrees. Alternatively, angle 1269 may be any size angle. Extension surface 1268 may be smooth, i.e., without ridges, to facilitate return of game playing member 1400.

As shown in FIG. 16, extension surface 1268 may have a length 1265, wherein length 1265 that is shorter than a length 1267 of return surface 1240. Moreover, extension surface 1268 may have a perimeter 1271 defined by a plurality of edges, wherein two edges may intersect. In one embodiment, extension surface 1268 is configured to resemble a "home plate" of a baseball field. Game playing surface 1200 further may include ledge 1250, proximate surface 1268, to facilitate retaining game playing member 400 in contact with game playing surface 1200.

Surface 1200 also may include a plurality of clip openings 1270, wherein each clip opening 1270 is configured to receive a clip 1131. In one embodiment, because surface 1227 slopes upward between surface 1213 and surface 1217, openings 1270 are at graduated heights between first surface 1213 and rear surface 1217. Particularly, openings 1270 ascend between edge 1223 and surface 1217. For example, ten openings 1270 may be formed within surface 1200 to correspond to the number of clips 1131, wherein two rows of five openings 1270.

At least one opening 1270 may be defined at each intersection of partition 1249 and surface 1227. Additionally, at least two openings 1270 may be defined within surface 1227 proximate front surface 1231 of center portion 1230 and at least two openings 1270 may be defined within surface 1227 proximate rear surface 1232 of center portion 1230. In one embodiment, each opening 1270 has a rectangular shape. Alternatively, opening 1270 may have any shape, so long as the shape facilitates receiving a clip 1131 therein.

Moreover, game playing surface 1200 may include at least one game playing member receptacle 1260. In one embodiment, surface 1200 includes two receptacles 1260, wherein one receptacle 1260 is proximate edge 1223 and another receptacle 1260 is proximate edge 1225. Each receptacle 1260 is configured to retain at least one game playing member 1400 and is shaped such that receptacle 1260 has a surface 1281 extending between a first end 1283 and a second end 1285. Surface 1281 may be an arcuate surface and may be shaped to reflect the shape of member 1400. Additionally, surface 1281 may include a plurality of notches (not shown) configured to hold at least one game playing member 1400 in place.

As shown in FIG. 11, game playing surface 1200 also may include rear ledge 1280. Rear ledge 1280 may include a top surface 1287, a bottom surface 1288, a front surface 1289, a rear surface 1291, a first side surface 1293, and a second side surface 1295. In one embodiment, side surfaces 1293 and 1295 are arcuate surfaces, wherein the width at top surface 1287 of rear ledge 1280 is less than the width at bottom surface 1288 of rear ledge 1280. Rear ledge 1280 may have a height that is substantially equal to height 1209 of game playing surface 1200. Moreover, rear ledge 1280 further may include indentation 1290 and may be configured to receive at least a portion of game playing backboard 1300.

Surface 1200 may further include at least one opening (not shown) configured to receive a mechanism that lights up. For example, a post may be inserted into such an opening wherein the post has a light at one end for shining light onto apparatus 1000.

Furthermore, in one embodiment, game playing surface 1200 may be configured to fold to facilitate ease of transport and/or storage. Specifically, game playing surface 1200 may fold along a perforated or hinged fold (not shown) along axial plane 1111. Moreover, game playing surface 1200 may include at least one handle (not shown) coupled thereto to facilitate transporting and/or carrying apparatus 1000 and/or surface 1200.

To prevent apparatus 1000 from moving on the surface in which it is placed, surface 1200 may include at least one grip, pad, or other mechanism on bottom surface 1229. Moreover, a plurality of legs (not shown) may be coupled to bottom surface 1229 to vary the height between the substantially horizontal surface in which the game is placed upon and game playing surface 1200. In one embodiment, four legs are coupled to bottom surface 1229, such that each leg is coupled proximate a corner of surface 1200. Additionally, each leg may be between about 6" and 64" long, preferably between about 12" and 48" long, and in one embodiment, about 36" long.

Game Playing Backboard 1300

Figure 10:
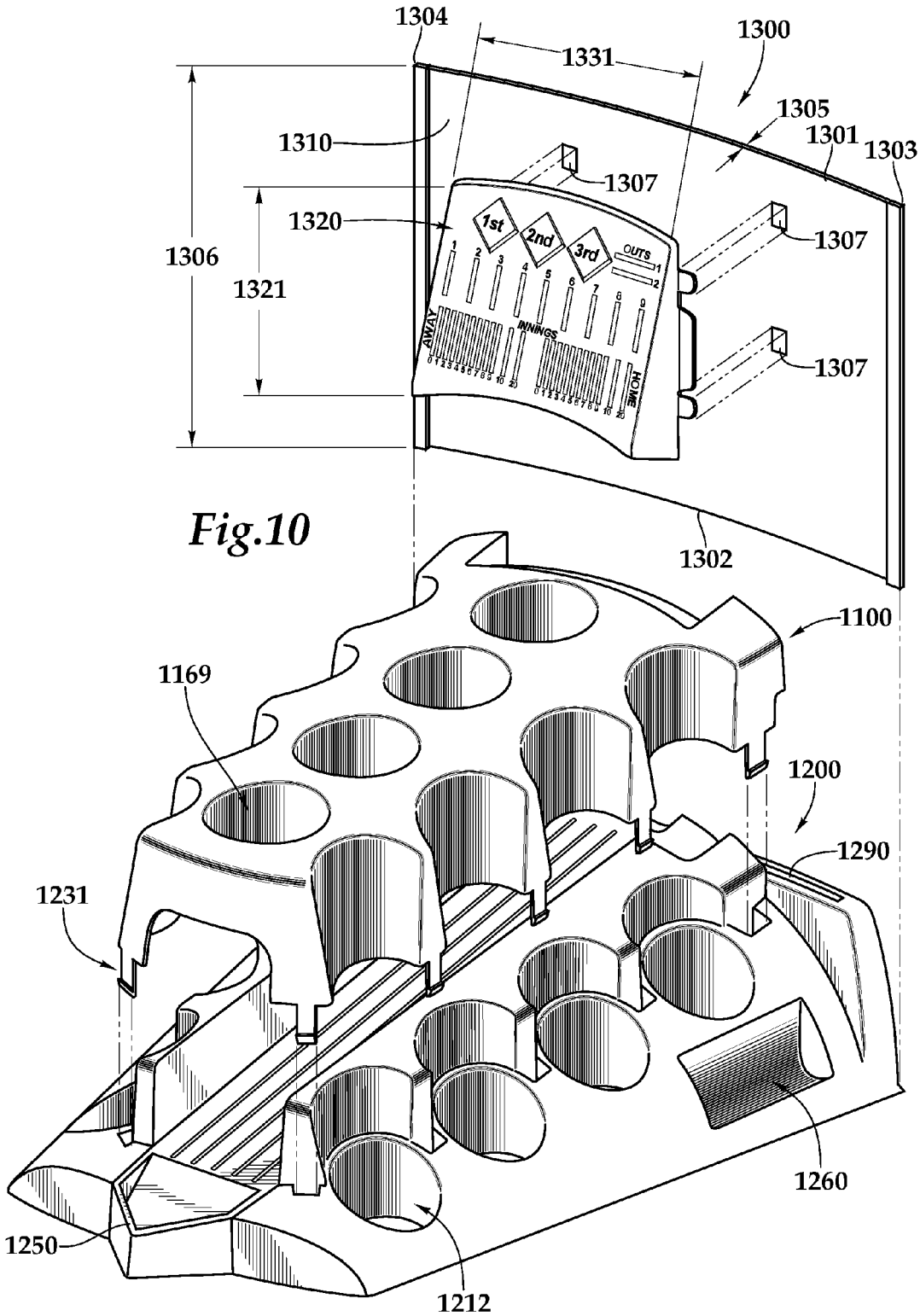
FIG. 10 is an exploded view of the game apparatus shown in FIG. 1.

Turning to FIG. 10, apparatus 1000 may include game playing backboard 1300. Game playing backboard 1300 may be configured to receive scoring member 1320 and may be configured to prevent a member 1400 from being tossed apparatus 1000.

In one embodiment, backboard 1300 is fabricated from a semi-rigid material that enables backboard 1300 to stand erect when inserted into indentation 1290 of surface 1200; however, backboard 1300 should have some flexibility to enable it to bend to accommodate the arcuate shape of indentation 1290. For example, backboard 1300 may be formed of a paperboard or cardboard material. Alternatively, backboard 1300 may be fabricated from any suitable material. For example, backboard 1300 may be fabricated of metal, plastic, wood, laminate, glass, mesh, cloth, netting, and/or any combination thereof. In one embodiment Additionally, an image (not shown), such as a picture of having a baseball stadium, baseball seats, and/or baseball fans, may be printed or affixed to a front surface 1310 of backboard 1300 to enhance the appearance of the apparatus 1000.

Backboard 1300 may include a top edge 1301, a bottom edge 1302, a first side edge 1303, a second side edge 1304, and a front surface 1310. In one embodiment, backboard 1300 is generally rectangular having a width 1305 and a height 1306, wherein width 1305 is greater than height 1306. Width 1305 may be between about 1" and about 15", preferably between about 5" and about 12", and in one embodiment about 13". Height 1306 may be between about 1" and about 15", preferably between about 5" and about 12", and in one embodiment about 8¾".

Backboard 1300 may include at least one opening or slot 1307 defined therein to receive a portion of scoring member 1320 therein. In one embodiment, as shown in FIG. 10, four openings 1307 are defined within backboard 1300. Each opening 1307 may have a rectangular shape; however, each opening 1307 may have any shape or size that facilitates coupling scoring member 1320 to backboard 1300.

Additionally, backboard 1300 may include at least one guard or support proximate at least one edge of backboard 1300, wherein a support may be coupled to edge 1303 and another support may be coupled to edge 1304 to facilitate holding backboard erect and substantially perpendicular to surface 1200. The guards may be yellow in color and resemble foul posts and/or centerfield posts. Alternatively, backboard 1300 may not include any guard or support.

Backboard 1300 may also be configured to receive attachments in addition to scoring member 1320 that facilitate game play.

Figure 13:
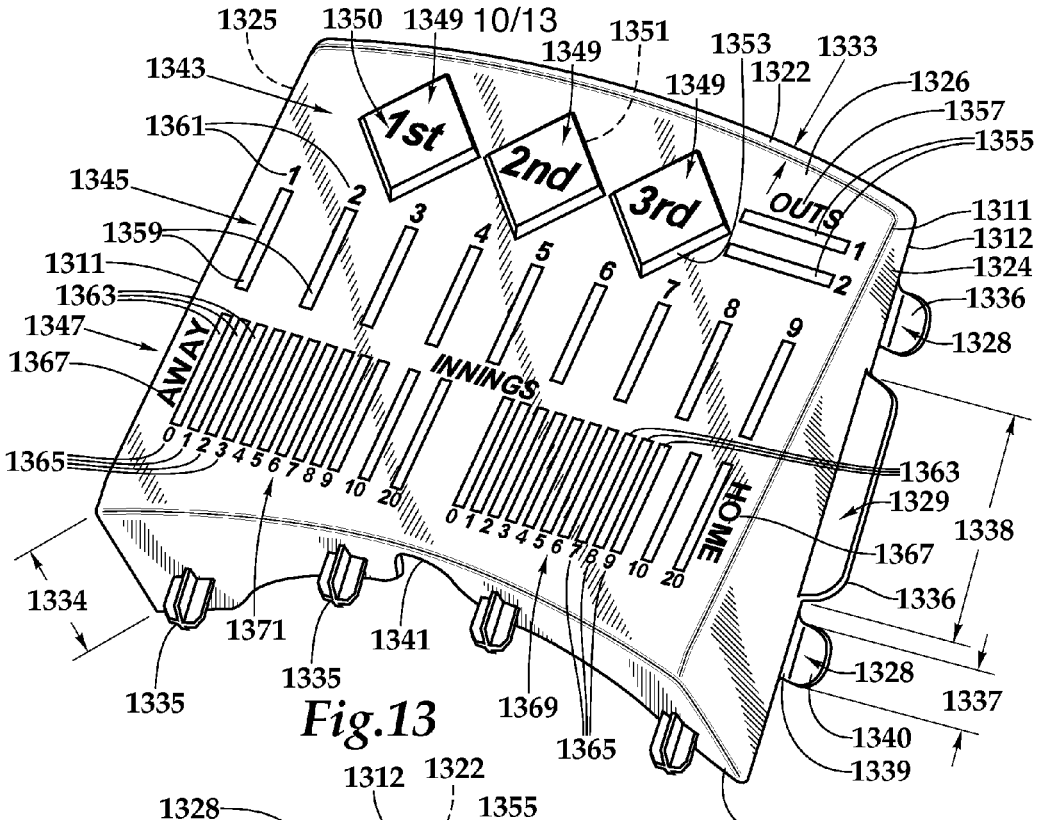
FIG. 13 is a perspective front view of a scoring member shown in FIG. 1.

Turning to FIG. 13, apparatus 1000 also may include a game scoring member 1320 that is configured to keep the score of the game and may be configured to couple to backboard 1300.

Scoring member 1320 may be fabricated of a plastic material that is injected molded. Alternatively, scoring member 1320 may be fabricated from a white-board material that easily enables players to draw on member 1320 and easily erase and/or clean the member 1320. For example, member 1320 may be fabricated from paper, dry erase board, and/or chalk board. In another embodiment, member 1320 may include a sliding mechanism, flip cards, magnets, and/or push buttons that enable a player to slide and/or move the same along and/or on member 1320 to keep track of the score. In a further embodiment, display portion of member 1320 may include an electronic display portion and may digitally display the scores for each team. In another embodiment, member 1320 may be an electronic member that automatically keeps track of the score. When scoring member 1320 includes an electronic display portion and/or an electronic member, a power source would be configured to power member 1320.

Scoring member 1320 may include a top surface 1322, a bottom surface 1323, a first side surface 1324, a second side surface 1325, a front surface 1326, and an opposing rear surface 1327. Moreover, scoring member 1320 may include a plurality of flanges 1328 and tabs 1329 extending outward from surfaces 1324 and 1325, a plurality of projections 1335 extending outward from surface 1323, and a plurality of record keeping depressions or slots.

In one embodiment, top surface 1322 has a width 1333 and bottom surface 1323 has a width 1334, wherein width 1334 is greater than width 1333. Additionally, each side surface 1324, 1325 may be wider proximate top surface 1322 than the width of each side surface 1324, 1325 proximate bottom surface 1323. Moreover, each side surface 1324 and 1325 has a first edge 1311, proximate front surface 1326, and a second edge 1312, proximate rear surface 1327. Furthermore, front surface 1326 may have a slight concave shape between surfaces 1324 and 1325.

Scoring member 1320 may also have a height 1321 and a length 1331. Height 1321 may be between about 1" and about 10", preferably between about 3" and about 8", and in one embodiment about 4½". Length 1331 may be between about 1" and about 10", preferably between about 3" and about 8", and in one embodiment about 5¾".

Flanges 1328 and tabs 1329 may be configured to engage backboard 1300 to couple scoring member 1320 to backboard 1300, wherein flanges 1328 may be configured to engage openings 1307 in backboard 1300 and tabs 1329 are configured to engage surface 1310 of backboard 1300. Flanges 1328 and tabs 1329 may extend outward from surfaces 1324 and 1325 proximate rear edges 1312. In one embodiment, each surface 1324 and 1325 includes two flanges 1328 and one tab 1329, wherein tab 1329 is positioned between flanges 1328. Each flange 1328 may have a first portion 1339 and a second portion 1340, wherein each first portion 1339 is substantially parallel to surfaces 1324 and 1325 and wherein each second portion 1340 is substantially perpendicular to first portion 1339 and surfaces 1324 and 1325. Moreover, each tab 1329 may be substantially perpendicular to surfaces 1324 and 1325.

Each flange 1328 may have a length 1337 and each tab 1329 may have a length 1338, wherein length 1338 may be greater than length 1337. In one embodiment, length 1338 is over three times length 1337. Moreover, each flange 1328 and each tab 1329 may have an edge 1336 that is arcuately shaped.

Additionally, scoring member 1320 may include projections 1335 that extend downward from surface 1323 and may be inserted into depressions 1167 of surface 1200. Preferably, projections 1335 have a shape complementary to the shape of depressions 1167. In one embodiment, there are four projections 1335 extending downward from surface 1323.

Moreover, scoring member 1320 may have a cutout portion 1341 defined within surface 1323. Cutout portion 1341 may facilitate coupling member 1320 to backboard 1300 and surface 1200.

Front surface 1326 of scoring member 1320 further may include a display portion, which may include a plurality of record keeping depressions. The record keeping depressions may be arranged in a plurality of rows 1343, 1345 and 1347.

First row 1343 may include a plurality of slots 1349 and two depressions 1355. Slots 1349 may be labeled with labels 1350 reading "1st," "2nd," and "3rd." Labels 1350 may be affixed to slots 1349 in any reasonable manner. Moreover, slots 1349 may have a diamond shape and be configured to receive a game playing member 1400. Each slot 1349 may have an open end 1351 proximate the top of slot 1329 configured to receive member 1400, and each slot 1349 may have a closed end 1353 proximate the bottom of the slot 1349 to prevent member 1400 from falling through slot 1349. Depressions 1355 are also configured to receive game playing members 1400. A plurality of labels 1357 may be affixed to surface 1326 proximate depressions 1355. In one embodiment, labels 1357 read "outs," "1," and "2."

Second row 1345 may include a plurality of depressions 1359. In one embodiment, row 1345 includes nine separate depressions 1359, wherein each depression 1359 has an open end, shown in FIG. 13, to receive a member 1400 and a closed end, shown in FIG. 14, to retain a member 1400 within depression 1359. Additionally, a plurality of labels 1361 may be affixed to surface 1326 proximate depressions 1355. In one embodiment, each depression 1355 includes a label 1361 with a number ranging from 1 to 9, wherein the number is representative of an inning of a baseball game, and row 1345 includes a label 1361, wherein the label reads "innings."

Third row 1347 includes a plurality of depressions 1363. In one embodiment, each depression 1363 has an open end, shown in FIG. 13, to receive a member 1400 and a closed end, shown in FIG. 14, to retain member 1400 within depression 1363. Depressions 1363 may be separated into two groups, a "home" group 1369 and an "away" group 1371.

Figure 14:
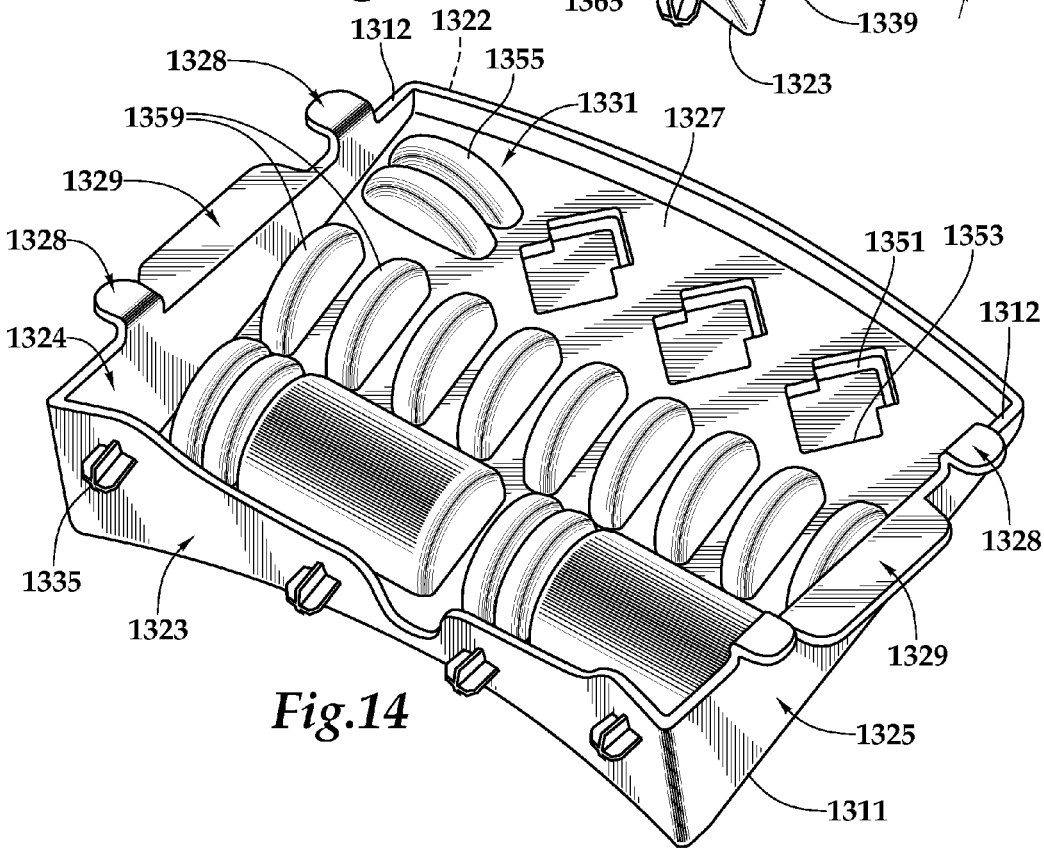
FIG. 14 is a perspective rear view of the scoring member shown in FIG. 13.

In one embodiment, "home" group 1369 includes a depression 1363 with a plurality of openings to receive members 1400, as shown in FIG. 13, and a single closed end, shown in FIG. 14, to retain members 1400 therein. Specifically, "home" group 1369 may include nine openings to receive members 1400, wherein a label 1365 may be affixed to surface 1326 proximate each opening. Label 1365 may be a number ranging from 1 to 9, 10, or 20, wherein the number is representative of the score of the "home" team. "Home" group 1369 also includes additional depressions 1363, wherein each additional depression 1363 has an open end and a closed end. A label 1367 that reads "home" may be affixed proximate "home" group 1369.

In one embodiment, the "away" group 1371 includes a depression 1363 with a plurality of openings to receive members 1400, as shown in FIG. 13, and a single closed end, shown in FIG. 14, to retain members 1400 therein. Specifically, "away" group 1369 may include nine openings to receive members 1400, wherein a label 1365 may be affixed to surface 1326 proximate each opening. Label 1365 may be a number ranging from 1 to 9, 10, or 20, wherein the number is representative of the score of the "away" team. "Away" group 1369 also includes additional depressions 1363, wherein each additional depression 1363 has an open end and a closed end. A label 1367 that reads "home" may be affixed proximate "home" group 1369.

Depressions 1359 and 1363 may be substantially perpendicular to depressions 1355.

Game Playing Member 1400

Game playing member 1400 may be any member that can be tossed towards apparatus 1000 and is preferably smaller than diameter of each receptacle 1169 such that game playing member 1400 may be tossed toward apparatus 1000. Game playing member 1400 is preferably a member that can tossed towards a surface and bounce towards apparatus 1000. For example, game playing member 1400 may be a metal slug. In one embodiment, metal slug may have the size and the weight of a quarter. In one embodiment, game playing member 1400 may be, but is not limited to being, other coin such as pennies or dimes, dice, a member fabricated from plastic, a member fabricated from wood, a member fabricated from paper, a member fabricated from a rubberized material, and/or any combination thereof.

Game Bouncing Surface 1500

Figure 18:
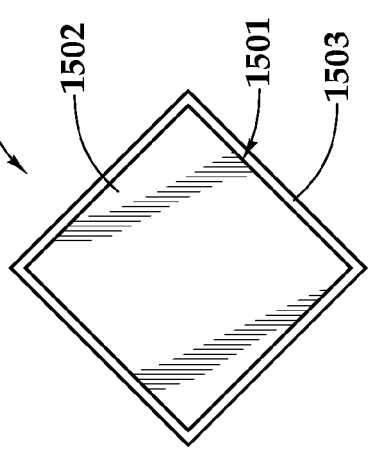
FIG. 18 is a top view of a game bouncing surface to be used with the game apparatuses shown in FIGS. 1 and 1A.

Along with apparatus 1000, a game bouncing surface 1500, as shown in FIG. 18, may be positioned proximate front end 1213 of surface 1200 to facilitate game play. Game bouncing surface 1500 may include a base 1501 and a surface 1502 coupled to base 1501.

In one embodiment, game bouncing surface 1500 is a diamond shape. Alternatively, surface 1500 may have any suitable shape that facilitates game play.

Base 1501 may be fabricated of plastic and may include a plurality of ledges 1503 along the perimeter of base 1501, wherein ledges 1503 may facilitate retaining surface 1502. Alternatively, base 1501 may be fabricated from metal, paper, wood, rubber, and/or any combination thereof.

Additionally, surface 1502 may be sized to fit within base 1501, and, in one embodiment, surface 1502 is fabricated from a rubberized material. Alternatively, surface 1502 may be fabricated from any material with elastic properties to facilitate bouncing when a member 1400 hits surface 1502.

Moreover, to prevent surface 1500 from moving when in use, surface 1500 may include at least one grip, pad, or other mechanism on its bottom surface.

Method of Assembly

Game playing apparatus 1000 may be assembled by placing surface 1200 on a substantially flat horizontal surface such as a counter or floor. Body 1100 is coupled to surface 1200 by inserting clips 1131 into respective openings 1270 within surface 1200. When clips 1131 are inserted into openings 1270, at least one surface of wall 1141 may engage a portion of wall 1241 aligning indentations 1137 with indentations 1237. Moreover, when coupling body 1100 and surface 1200, a portion of ledge 1157 may contact a portion of ledges 1257 and 1258. Cups 1115 may be inserted into receptacles 1212, and each cup 1115 may contact at least one wall 1141 of indentation 1137.

Game scoring member 1320 may be coupled to backboard 1300. Specifically, flanges 1328 may be inserted into openings 1307, and tabs 1329 may contact surface 1310. Both game scoring member 1320 and backboard 1300 may be inserted into rear indentation 1290, wherein projections 1335 of game scoring member 1320 may engage depressions 1167 in ledge 1157 of member 1100 to stabilize and hold game scoring member 1320 and backboard 1300 in an erect position.

Method of Use

Game playing apparatus 1000 is a baseball-themed apparatus configured to facilitate playing a baseball-themed game. The baseball-themed game is played with at least two players or batters, a consumable liquid and/or food and/or a door prize (i.e., object), a plurality of cups 1115, and a plurality of game playing members 1400. To prepare to play the game, divide the at least two players into two teams and organize a batting order within each team. Determine which team is the visiting team, which will bat or play first, and the remaining team is the home team, which will bat or play second. Apparatus 1000 should be placed on any table, countertop, or a substantially horizontal surface. Preferably, apparatus 1000 is positioned approximately one foot from the edge of the table or countertop. In one embodiment, apparatus 1000 is positioned on the floor. Also, in one embodiment, apparatus 1000 is elevated and/or adjusted by a plurality of legs coupled to surface 1229. Moreover, game bouncing surface 1500 may be positioned in front of apparatus 1000 to facilitate bouncing member 1400 on surface 1500 towards apparatus 1000.

Once apparatus 1000 is in position, at least one cup 1115 is placed within each cup receptacle 1212. In another embodiment, at least one cup 1115 may be placed within select cup receptacles 1212. In one embodiment, cups 1115 placed proximate first edge 1223 are considered the home team's cups and cups 1115 placed proximate second edge 1225 are considered the visiting team's cups. Cups 1115 within apparatus 1000 are then filled with the chosen consumable liquid or food or door prize. Cups 1115 may be labeled to prevent confusion between teams. Moreover, different color cups may be used to prevent confusion. Also, cups 1115 may be of varying sizes depending on multiple factors such as the size of apparatus 1000, the size of cup receptacles 1212, and the liquid or food or door prize being used to play the game.

To begin playing the game, a first player on the visiting team stands near the edge of the table and/or counter. The players may position a mark or spot on the floor to indicate where a player should stand when it is his/her turn to play. If apparatus 1000 is on a table, the mark may be positioned between about 0.5 foot and about 4 feet away from apparatus 1000, preferably between about 1 foot and 2 feet, and in one embodiment about 1½ feet. If apparatus 1000 is on the floor, the mark may be positioned at least about 2 feet away from apparatus 1000.

Once the first player is in position, the player tosses game playing member 1400 towards the table and/or counter and/or surface 1500 in an attempt to bounce game playing member 1400 on at least one of surface 1500, the table, counter, and/or floor such that member 1400 projects towards apparatus 10. In another embodiment, member 1400 is tossed directly towards apparatus 1000, without bouncing member 1400.

The goal of bouncing member 1400 is to project member 1400 towards apparatus 1000, such that member 1400 preferably lands within at least one receptacle 1169 wherein each receptacle 1169 may be labeled with at least one of single, double, triple, and home run. The convex shape of top surface 1127 of body 1100 facilitates channeling member 1400 towards receptacle 1169 or toward cups 1115. If the player bounces member 1400 into a receptacle 1169, member 1400 will slide down at least one surface, curved rear surface 1177 or curved front surface 1179, towards egress 1175. Once member 1400 exits egress 1175, return surface 1240 will return member 1400 to front end 1213 and ledge 1250 will retain game playing member 1400 within apparatus 1000.

If the player bounces member 1400 into a receptacle 1169, the opposing team must consume the liquid and/or food and/or remove the door prize within the cup 1115 (labeled for their team) that is in receptacle 1212 that is beside receptacle 1169 that member 1400 landed within. Moreover, the opposing team must consume the liquid and/or food and/or remove the door prize within the cups 1115 that are positioned between front end 1213 and the cup 1115 next to the receptacle 1169 that member 1400 landed within. For example, if a home team player bounces member 1400 into receptacle 1169 labeled "triple," then the visiting team is to consume the food and/or liquid and/or remove the door prize within the visiting team's cup 1115 next to the receptacle labeled "single," the visiting team's cup 1115 next to the receptacle labeled "double," and the visiting team's cup 1115 next to the receptacle labeled "triple." Moreover, if the player gets a "triple," then it is recorded. However, if each team only has one player, the player only consumes the liquid and/or food and/or removes the door prize within the cup 1115 that is positioned next to receptacle 1169 that member 1400 landed within. Similarly, if the player bounces member 1400 and it is considered a "grand slam," as defined by the players, then the opposing team must consume all cups 1215 for both the visiting and the home team.

On the other hand, if the player does not bounce member 1400 into a receptacle 1169, an out is recorded.

If the player tosses member 1400 into one of the cups 1115, an out is recorded and the batting team (or the team in which the most recent player that just tossed member 1400 towards apparatus 1000) must drink and/or eat the liquid and/or food and/or remove the door prize within the cup 1115 that member 1400 landed in. Once that cup 1115 is emptied of the liquid and/or food and/or door prize, cup 1115 is refilled and returned to receptacle 1212.

While the game is being played, the score, the runs, the innings, and the outs are all tallied and kept track of on at least one of the scoring member 1320. If one team gets three outs, the teams switch. In other words, the players from the other team are to toss member 1400 or are "up to bat". Once each team has batted, the next inning begins. The team with the most runs recorded after a predetermined number of innings, e.g., after nine innings, wins the game.

If the number of runs exceeds nine, then a game playing member 1400 is inserted into the receptacle 1363 labeled with "10" and another game playing member 1400 is inserted into another receptacle 1363 labeled with a number between "0" and "9." As such, the number of runs will be equal to equal to the number "10" plus the number between "0" and "9."

If there is a tie, the players choose how to settle the game. For example, additional innings may be played. In another embodiment, the game is won when a predetermined event occurs.

Apparatus 1000

A game playing apparatus 1000 configured to facilitate playing a game is provided. Apparatus 1000 may include a body 1100 having a plurality of sides 1123 and 1125. Body 1100 may include a plurality of receptacles 1169. Each receptacle 1169 has an ingress 1171 with an inclined surface 1177 extending downward from ingress 1171 to facilitate return of a game playing member 1400, and a plurality of indentations 1137 in at least one side 1123 and 1125. Apparatus 1000 further may include a game surface 1200 coupled to body 1100. Game surface 1200 may include a return surface 1240 beneath the plurality of receptacles 1169 to further facilitate return of the game playing member 1400, and a plurality of holders 1212. Plurality of holders 1212 and plurality of receptacles 1169 are configured to receive a plurality of cups 1115 therein.

Moreover, a game playing apparatus 1000 configured to facilitate playing a game is provided. Game playing apparatus 1000 may include a body 1100 having a plurality of sides 1123 and 1125. Body 1100 may include a plurality of receptacles 1169. Each receptacle 1169 includes an ingress 1171 with a first inclined surface 1177 and a second inclined surface 1179, wherein each first and second inclined surface extends downward from the ingress to facilitate return of a game playing member 1400. Each receptacle 1169 also may include an egress 1175 defined by the first and second inclined surfaces. Body 1100 further may include a plurality of indentations 1137 in at least one side. Apparatus 1000 also may include a game surface 1200 coupled to the body 1100. Game surface 1200 may include a return surface 1240 beneath the plurality of receptacles 1169 to further facilitate return of the game playing member 1400, wherein the return surface has a plurality of ridges 1262. Surface 1200 also may include a plurality of holders 1212, wherein the plurality of holders and the plurality of receptacles are configured to receive a plurality of cups 1115 therein. Apparatus 1000 may also include a backboard 1300 coupled to at least one of the game surface 1200 and the body 1100, and a scoreboard 1320 coupled to at least one of the backboard 1300 and the body 1100. Scoreboard 1320 may include a plurality of depressions formed therein. Each depression may be configured to receive a game playing member 1400.

The apparatus of the present invention provides a game playing apparatus that is easy to use, that is cost-effective, and has increased functionality. Specifically, the present invention provides an apparatus to facilitate the playing of a baseball themed game. Moreover, the present invention provides a game apparatus that may be used with other similar games including, but not limited to, other sports games such as football.

While the foregoing written description of the invention enables one of ordinary skill to make and use what is considered presently to be the best mode thereof, those of ordinary skill will understand and appreciate the existence of variations, combinations, and equivalents of the specific exemplary embodiment and method herein. The invention should therefore not be limited by the above described embodiment and method, but by all embodiments and methods within the scope and spirit of the invention as claimed.

What is claimed is:

1. A game playing apparatus configured to facilitate playing a game, the game playing apparatus comprising:

a body having a plurality of sides, the body comprising:

a plurality of receptacles, wherein each receptacle has an ingress with an inclined surface extending downward from the ingress to facilitate return of a game playing member, and a plurality of indentations in at least one side; and a game surface coupled to the body, the game surface comprising:

a return surface beneath the plurality of receptacles to further facilitate return of the game playing member, and a plurality of holders, wherein the plurality of holders and the plurality of receptacles are configured to receive a plurality of cups therein.

2. An apparatus according to claim 1 further comprising a backboard coupled to at least one of the game surface and the body.

3. An apparatus according to claim 2 further comprising a scoreboard is coupled to at least one of the backboard and the body.

4. An apparatus according to claim 3 wherein the scoreboard further comprises a plurality of depressions formed therein, wherein each depression is configured to receive a game playing member.

5. An apparatus according to claim 1 wherein the inclined surface is a first inclined surface, and further wherein each receptacle has a second inclined surface extending downward from the ingress to facilitate return of a game playing member.

6. An apparatus according to claim 5 wherein each receptacle has an egress, wherein the egress if defined by the first inclined surface and the second inclined surface of each receptacle.

7. An apparatus according to claim 1 wherein the body further comprises a plurality of clips configured to couple the body to the game surface.

8. An apparatus according to claim 7 wherein the surface further comprises a plurality of openings, wherein each opening is configured to receive at least one clip.

9. An apparatus according to claim 1 wherein the return surface further comprises a plurality of ridges.

10. An apparatus according to claim 1 wherein the body further comprises a top surface, a first side surface and a second side surface, wherein the top surface is a convex surface between the first and second side surfaces.

11. An apparatus according to claim 10 wherein the top surface has indicia proximate each of the receptacles.

12. An apparatus according to claim 1 wherein the body is fabricated of a plastic material, and wherein the game surface is fabricated of a plastic material.

13. An apparatus according to claim 1 wherein the body further comprises a game playing member receptacle configured to retain at least one game playing member.

14. An apparatus according to claim 1 wherein the game playing member is a metal slug.

* * * * *